US008238784B2

(12) United States Patent
Kusudo et al.

(10) Patent No.: US 8,238,784 B2
(45) Date of Patent: Aug. 7, 2012

(54) PROCESS CARTRIDGE REMANUFACTURING METHOD

(75) Inventors: Ryoji Kusudo, Mishima (JP); Naoki Matsumaru, Boise, ID (US)

(73) Assignee: Canon Kabushiki Kaisha, Tokyo (JP)

( * ) Notice: Subject to any disclaimer, the term of this patent is extended or adjusted under 35 U.S.C. 154(b) by 637 days.

(21) Appl. No.: 12/258,834

(22) Filed: Oct. 27, 2008

(65) Prior Publication Data

US 2009/0110434 A1 Apr. 30, 2009

(30) Foreign Application Priority Data

Oct. 31, 2007 (JP) ..... 2007-283422

(51) Int. Cl.
*G03G 21/16* (2006.01)

(52) U.S. Cl. ..... 399/109; 399/111

(58) Field of Classification Search ..... 399/111, 399/109

See application file for complete search history.

(56) References Cited

U.S. PATENT DOCUMENTS

| | | | | |
|---|---|---|---|---|
| 6,542,706 | B2 * | 4/2003 | Toba et al. | 399/111 |
| 6,795,666 | B2 | 9/2004 | Miyabe et al. | 399/109 |
| 6,952,543 | B2 | 10/2005 | Kusudo | 399/90 |
| 6,963,706 | B2 | 11/2005 | Morioka et al. | 399/111 |
| 7,062,195 | B2 | 6/2006 | Kurihara et al. | 399/102 |
| 7,203,442 | B2 | 4/2007 | Matsubara et al. | 399/90 |
| 7,366,441 | B2 * | 4/2008 | Hatori | 399/113 |
| 7,509,071 | B2 | 3/2009 | Yoshimura et al. | |
| 2003/0113131 | A1 * | 6/2003 | Watanabe et al. | 399/111 |
| 2004/0091282 | A1 * | 5/2004 | Yokoi | 399/109 |
| 2006/0034637 | A1 * | 2/2006 | Kim et al. | 399/228 |
| 2007/0160388 | A1 * | 7/2007 | Yoshimura et al. | 399/111 |
| 2009/0238603 | A1 * | 9/2009 | Kusudo et al. | 399/111 |

FOREIGN PATENT DOCUMENTS

| | | |
|---|---|---|
| JP | 2002278423 | 9/2002 |
| JP | 2007213025 | 8/2007 |

OTHER PUBLICATIONS

Office Action in Japanese Patent Application No. 2007-283422, dated Aug. 25, 2009 (with excerpt translation).

* cited by examiner

*Primary Examiner* — David Gray
*Assistant Examiner* — G. M. Hyder
(74) *Attorney, Agent, or Firm* — Fitzpatrick, Cella, Harper & Scinto

(57) ABSTRACT

A remanufacturing method includes dismounting, from one end of a drum frame, a supporting member while rotatably supporting one end of a drum and a developing device frame; separating the two frames; dismounting the drum; mounting one end of a fresh drum to the other end of the drum frame; a refilling developer into a developer accommodating portion of the separated developing device frame; and swingably connecting the developing device frame and the drum frame by mounting the supporting member to one end of the drum frame, while rotatably supporting, by the supporting member, the one end of the drum of the drum frame to which the fresh drum has been mounted and swingably supporting the one end of the developing device frame to the developer accommodating portion of which the developer has been refilled, by the drum frame.

13 Claims, 24 Drawing Sheets

PROCESS CARTRIDGE REMANUFACTURING METHOD

FIELD OF THE INVENTION AND RELATED ART

The present invention relates to a method for remanufacturing a process cartridge, which is removably mountable in the main assembly of an electrophotographic image forming apparatus.

In this specification, the term "process cartridge" refers to a cartridge in which an electrophotographic photosensitive drum and at least the developing means among the various means for processing the photosensitive drum are integrally mounted, and which is removably mountable in the main assembly of an electrophotographic image forming apparatus.

In addition, the term "electrophotographic image forming apparatus" refers to an apparatus which forms an image on a recording medium with the use of an electrophotographic image forming method. As for examples of an electrophotographic image forming apparatus, an electrophotographic copying machine, an electrophotographic printer (an LED printer, a laser beam printer, etc.), a facsimile apparatus, a word processor, and the like, can be included.

The phrase "main assembly" of an electrophotographic image forming apparatus means refers to the portion of the electrophotographic image forming apparatus that remains after the removal of the process cartridge(s) from an electrophotographic image forming apparatus.

In the field of an electrophotographic image forming apparatus which uses an electrophotographic image forming process, a process cartridge system has been employed, which is a system that integrally places an electrophotographic photosensitive drum and one or more means for processing the electrophotographic photosensitive drum, in a cartridge which is removably mountable in the main assembly of an electrophotographic image forming apparatus.

A process cartridge system enables a user to maintain an image forming apparatus by himself or herself, that is, without help from a service person, and therefore, can significantly improve an image forming apparatus in operability.

An electrophotographic image forming apparatus is an apparatus which forms an image on a recording medium with the use of the developer stored in the developer storage portion of a process cartridge. In other words, the developer stored in the developer storage portion of a process cartridge is consumed by the developing means of the process cartridge. Therefore, as an image forming operation is repeated, the process cartridge becomes depleted of the developer in its developer storage portion. Thus, it has been thought to remanufacture a process cartridge depleted of the developer therein.

Usually, a process cartridge is made up of multiple (two, for example) frames bonded together. Therefore, according to the conventional process cartridge remanufacturing method, the joint portions of the process cartridge are cut off, and then, the multiple frames are re-bonded together, with the placement of spacers between (among) the frames (U.S. Pat. No. 6,795,666).

The present invention is a further development of the above described prior art.

SUMMARY OF THE INVENTION

The primary object of the present invention is to provide a process cartridge remanufacturing method which is substantially simpler than those in accordance with the prior art.

Another object of the present invention is to provide a process cartridge remanufacturing method for making reusable a process cartridge, from which the developer therein has been completely consumed.

Another object of the present invention is to provide a process cartridge remanufacturing method which is simpler in terms of the refilling of developer than those in accordance with the prior art.

According to an aspect of the present invention, there is provided a remanufacturing method for a process cartridge detachably mountable to a main assembly of the electrophotographic image forming apparatus, wherein the process cartridge includes a drum frame supporting one and the other longitudinal end portions of an electrophotographic photosensitive drum, and a developing device frame which supports one and the other longitudinal end portions of a developing roller for developing an electrostatic latent image formed on the electrophotographic photosensitive drum and which is provided with a developer accommodating portion for accommodating a developer usable for developing the electrostatic latent image by the developing roller, and wherein the drum frame and the developing device frame are rotatably connected with each other. The remanufacturing method comprise (i) a supporting member dismounting step of dismounting, from the drum frame, a supporting member mounted to the other longitudinal end portion of the drum frame while rotatably supporting the other end portion of the electrophotographic photosensitive drum and supporting the other longitudinal end portion of the developing device frame swingably by the drum frame; (ii) a frame separating step of separating the developing device frame and the drum frame from each other after the supporting member is dismounted by the supporting member dismounting step; (iii) a drum dismounting step of dismounting the one end portion of the electrophotographic photosensitive drum through one longitudinal end portion of the drum frame separated by the frame separating step; (iv) a drum mounting step of mounting one longitudinal end of a fresh electrophotographic photosensitive drum to the one end portion of the drum frame from which the electrophotographic photosensitive drum has been removed by the drum dismounting step; (v) a developer refilling step of refilling a developer into the developer accommodating portion of the developing device frame which has been separated by the frame separating step; and (vi) a frame coupling step of swingably connecting the developing device frame and the drum frame with each other by mounting the supporting member to the other end portion of the drum frame, while rotatably supporting, by the supporting member, the other end portion of the electrophotographic photosensitive drum of the drum frame to which the fresh electrophotographic photosensitive drum has been mounted and supporting the other end portion of the developing device frame to the developer accommodating portion of which the developer has been refilled, swingably by the drum frame.

The present invention makes it possible to provide a process cartridge remanufacturing method which is simpler than those in accordance with the prior art, and also, a process cartridge remanufacturing method which is simpler in terms of the refilling of developer than those in accordance with the prior art.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the most preferable embodiments of the present invention will be described in detail with reference to the appended drawings. However, the functions, materials, and shapes of the structural components in the following preferred embodiments, and their positional relationship, are not intended to limit the present invention in scope unless specifically noted. Further, if a structural component in one of the preferred embodiments is the same in material, shape, etc., as a structural component in another preferred embodiment, which was previously described, it will not be described.

Embodiment 1

First, a process cartridge to which the process cartridge remanufacturing method in accordance with the present invention is preferably applicable, and an electrophotographic image forming apparatus in which the process cartridge is removably mountable, will be described with reference to the appended drawings.

(General Description of Electrophotographic Image Forming Apparatus)

Figure 1:
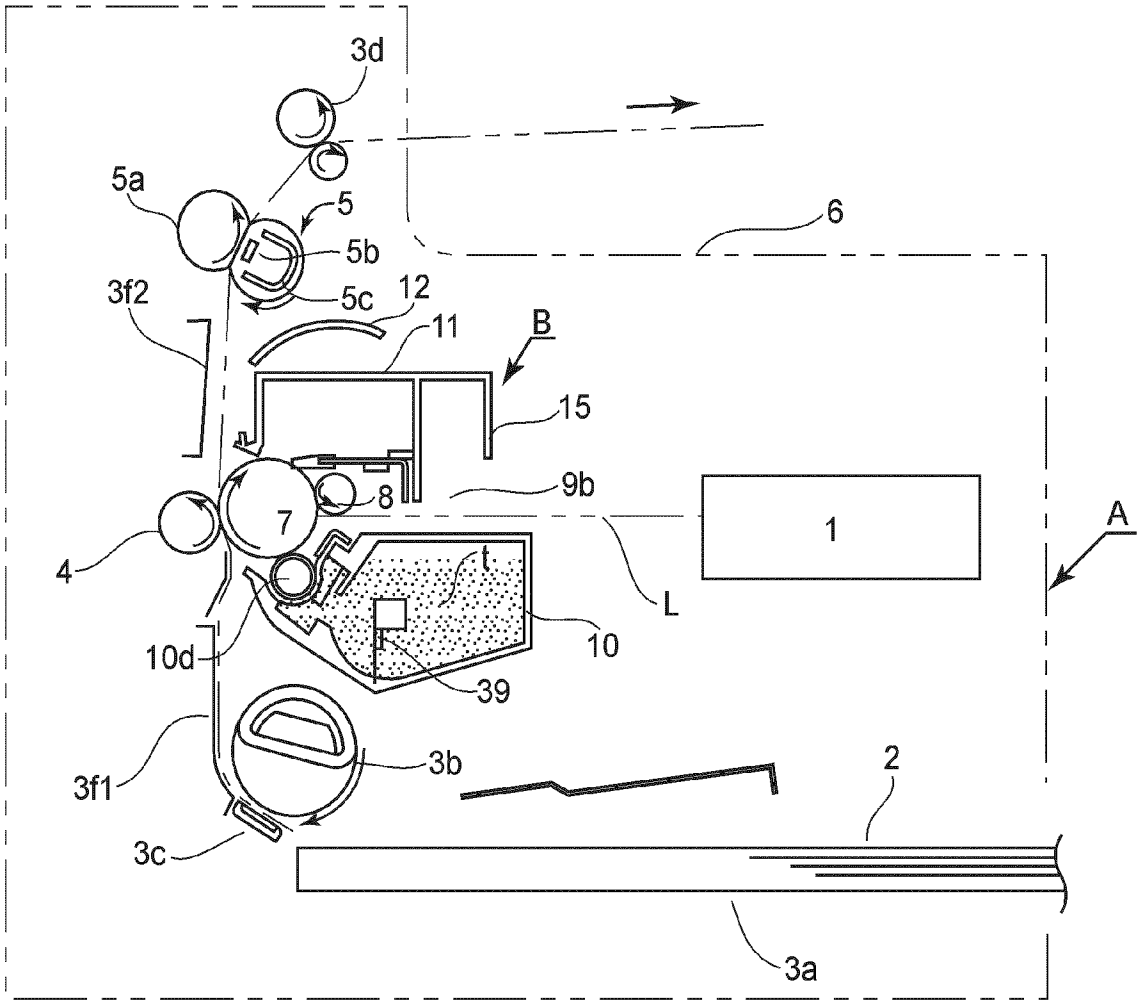
FIG. 1 is a schematic sectional view of a typical electrophotographic image forming apparatus after the completion of the mounting of a process cartridge into the main assembly of the apparatus.
Figure 2:
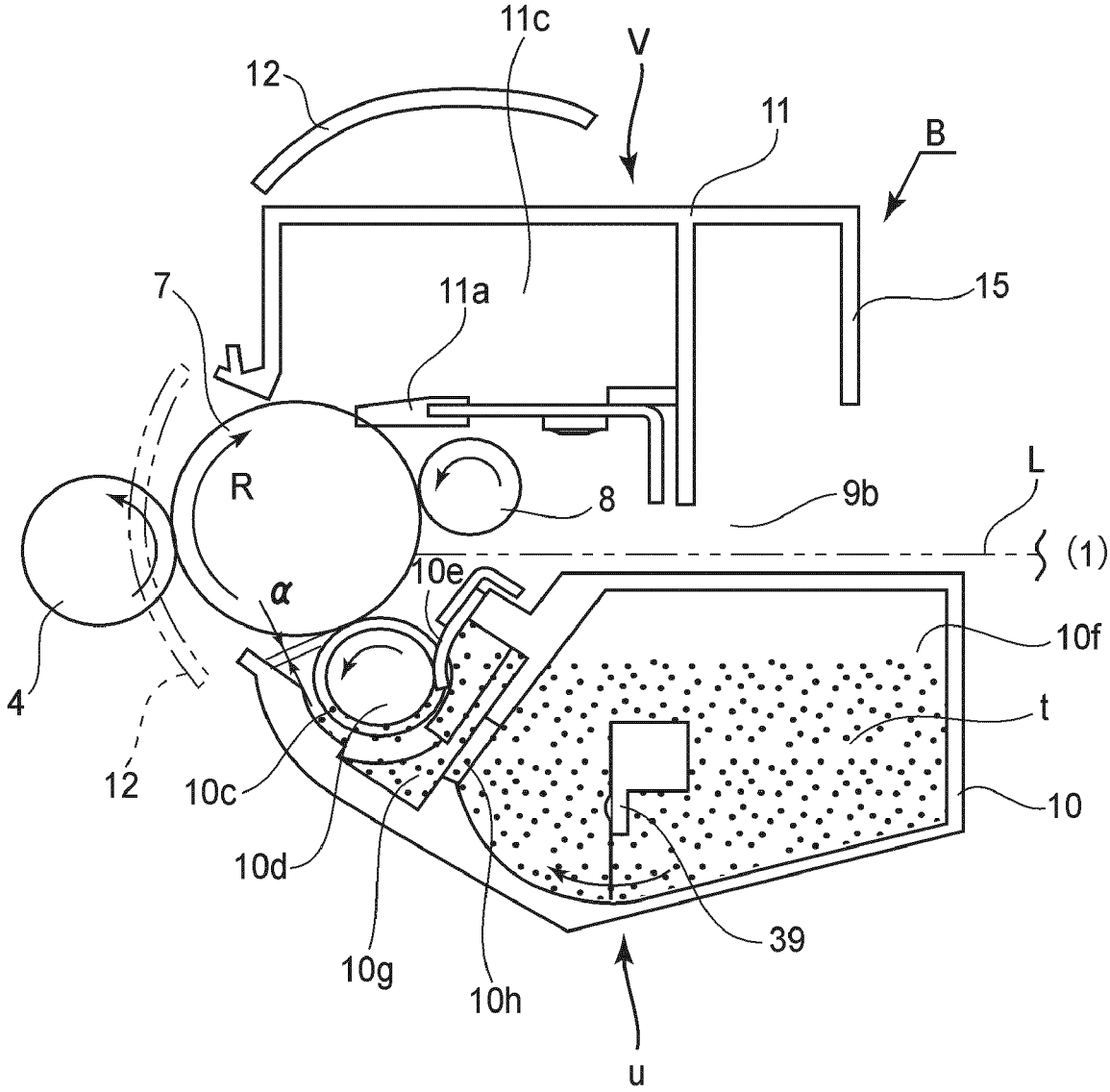
FIG. 2 is an enlarged sectional view of the process cartridge portion of FIG. 1.

First, referring to FIGS. 1 and 2, the general structure of a typical electrophotographic image forming apparatus will be described. FIG. 1 is a schematic sectional view of an electrophotographic image forming apparatus after the mounting of a process cartridge B, to which the present invention is applicable, into the main assembly A of the apparatus. FIG. 2 is an enlarged view of the process cartridge portion of FIG. 1.

In the following descriptions of the preferred embodiments of the present invention, a process cartridge will be referred to simply as a cartridge. The main assembly of an electrophotographic image forming apparatus will be referred to simply as an apparatus main assembly. Further, an electrophotographic photosensitive drum (electrophotographic photosensitive member which is in the form of drum and has photosensitive layer) may be referred to as a photosensitive drum.

A photosensitive drum 7 is charged by a charge roller 8. Upon the charged photosensitive drum 7, a beam of laser light is projected from an optical system 1 while being modulated according to the information of an image to be formed. The letter L in the drawing designates the beam of laser light projected from the optical system 1. As the beam of laser light L is projected onto the photosensitive drum, an electrostatic latent image is formed on the photosensitive drum 7. The electrostatic latent image is developed by a development roller 10*d*. More specifically, a developer t is borne on the development roller 10*d*, which serves as a developer bearer. As a voltage is applied to the development roller 10*d*, the developer t transfers from the development roller 10*d* onto the photosensitive drum 7. As a result, a visible image is formed of the developer t on the photosensitive drum 7.

In synchronism with the above described formation of the visible image (image formed of developer t), sheets of recording media 2 (a recording paper, an OHP sheet, etc., which hereafter will be referred to simply as a recording medium 2) are fed into the main assembly A from a cassette 3*a* by a conveying means 3*b* while being separated one by one by the combination of the conveying means 3*b* and a separation pad 3*c*. Then, each recording medium 2 is conveyed to a transfer portion while being guided by a guiding plate 3*f*1. Then, the recording medium 2 is conveyed through the transfer portion. While the recording medium 2 is conveyed through the transfer portion, a voltage is applied to a transfer roller 4 as a transferring means. As a result, the visible image (image formed of developer t) formed on the photosensitive drum 7 in the image forming portion of the cartridge B is transferred onto the recording medium 2. Then, the recording medium 2 is conveyed to a fixing means 5 while being guided by a guiding plate 3*f*2. The fixing means 5 has a driver roller 5*a*, and a fixation roller 5*c* which contains a heater 5*b*. After being moved through the fixing means 5, the recording medium 2 is conveyed further by a pair of discharge rollers 3*d*, and then, is discharged into a delivery portion 6.

(Structure of Cartridge B)

The cartridge B is provided with the photosensitive drum 7, and at least the development roller 10*d* which is the processing means for developing an electrostatic latent image formed on the photosensitive drum 7.

Further, the cartridge B in this embodiment has the charging means and cleaning means in addition to the developing means. The charging means and cleaning means are also processing means.

Referring to FIG. 2, the operation for forming an image with the use of the cartridge B in this embodiment is as follow: The photosensitive drum 7 is rotated in the direction indicated by an arrow mark R. As the photosensitive drum 7 is rotated, the peripheral surface of the photosensitive drum 7 is uniformly charged by the charge roller 8 as a charging means. Then, the charged portion of the peripheral surface of the photosensitive drum 7 is exposed to the beam L of light, which is projected upon the charged portion from the optical system 1 through the exposure window 9*b* of the drum supporting frame 11 (photosensitive drum unit frame, cleaning means supporting frame). As a result, an electrostatic latent image is effected on the photosensitive drum 7. The development unit u is provided with a development blade 10*e* (developer regulating member) and a development roller 10*d*. The development blade 10*e* regulates the amount (thickness) of the developer that is allowed to be coated on the peripheral surface of the development roller 10*d*. The development unit u is also provided with a developer storage portion 10*f*, which stores the developer t which is supplied to the development roller 10*d*. As the body of developer t borne on the peripheral surface of the development roller 10*d* is regulated by the development blade 10*e*, a developer layer, which is uniform in thickness, is formed on the development roller 10*d*.

The developer on the development roller 10*d* is transferred onto the photosensitive drum 7 in the pattern of the abovementioned latent image by the application of a development bias to the development roller 10*d*. As a result, a visible image, which reflects the pattern of the latent image, is formed on the developer on the photosensitive drum 7. Then, the visible image formed of the developer is transferred onto the recording medium 2 by the application of a transfer bias to the transfer roller 4. After the transfer of the image formed of the developer onto the recording medium 2, the developer t remaining on the photosensitive drum 7 is removed by the cleaning blade 11*a* as a cleaning means. The removed developer t is collected in a storage portion 11*c* for the removed developer.

The drum unit u is provided with a protective shutter 12 for protecting the photosensitive drum 7. The protective shutter 12 is attached to the drum unit frame 11. When the cartridge B is not in use (when cartridge B is out of apparatus main assembly A), the protective shutter 12 is in the position, outlined in FIG. 2 by a double-dot chain line, into which it is rotated to protect the photosensitive drum 7. When the cartridge B is in use (when cartridge B is in its image forming position in apparatus main assembly A), the protective shutter 12 is in its position, outlined by a solid line in FIG. 2, into which it is rotated to expose the photosensitive drum 7 from the cartridge B. That is, the protective shutter 12 is attached to the drum unit frame 11 so that it can be rotationally moved between the abovementioned photosensitive drum protecting position and photosensitive drum exposing position.

Figure 3:
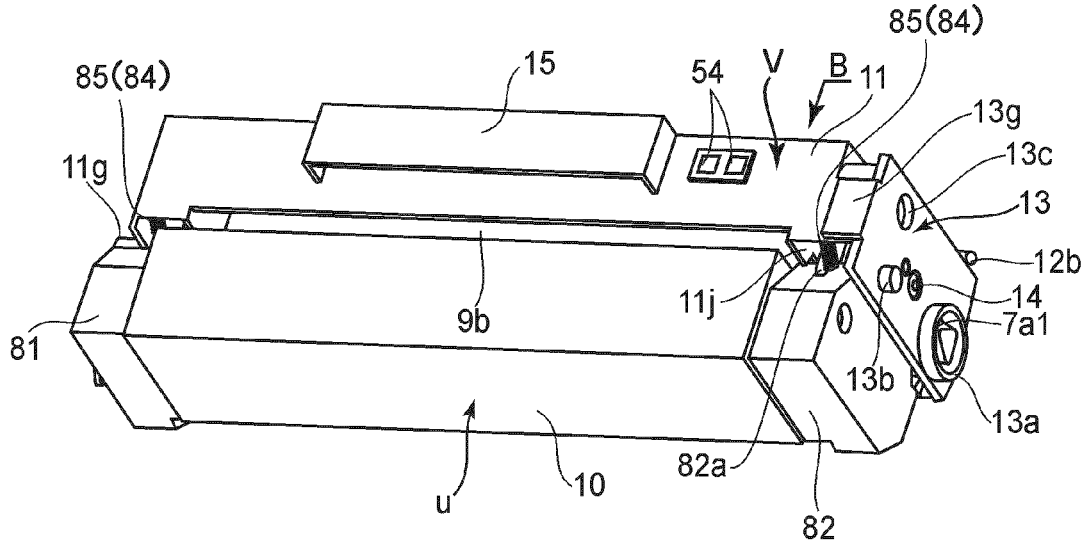
FIG. 3 is a perspective view of the process cartridge as seen diagonally from the side from which it is driven.
Figure 4:
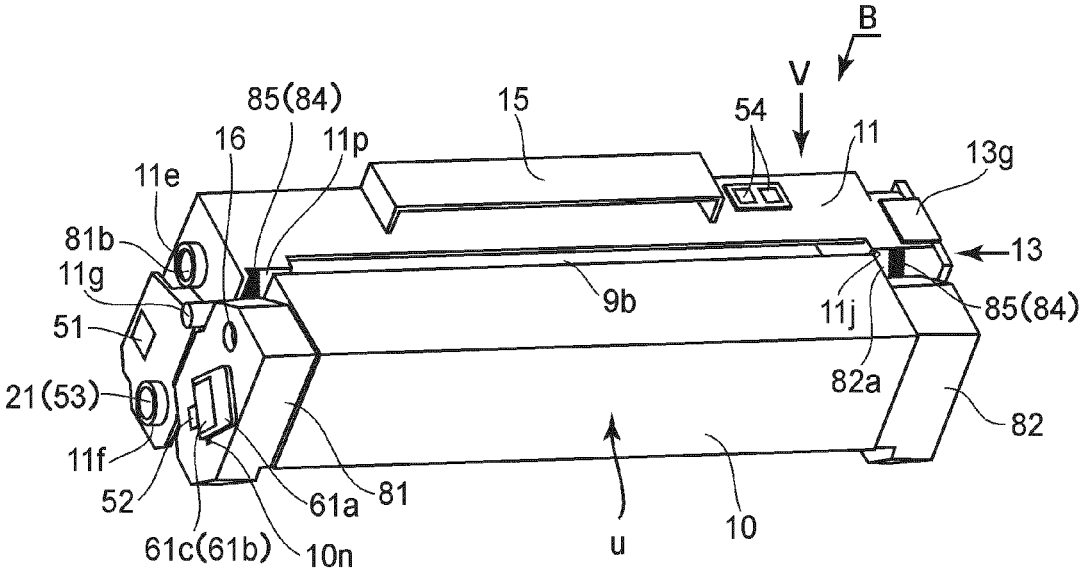
FIG. 4 is a perspective view of the process cartridge as seen diagonally from the opposite side from the side from which it is driven.
Figure 5:
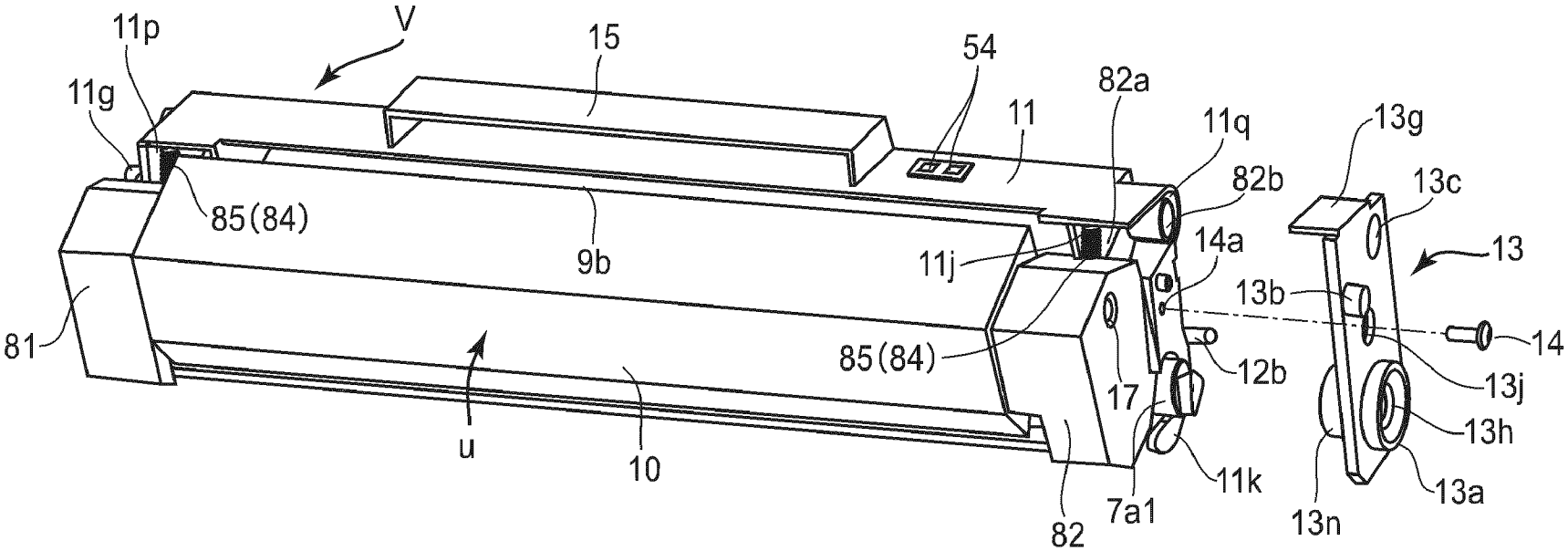
FIG. 5 is a perspective view of the cartridge after the separation of its supporting member from the lengthwise end of the cartridge, from which the cartridge is driven.
Figure 6:
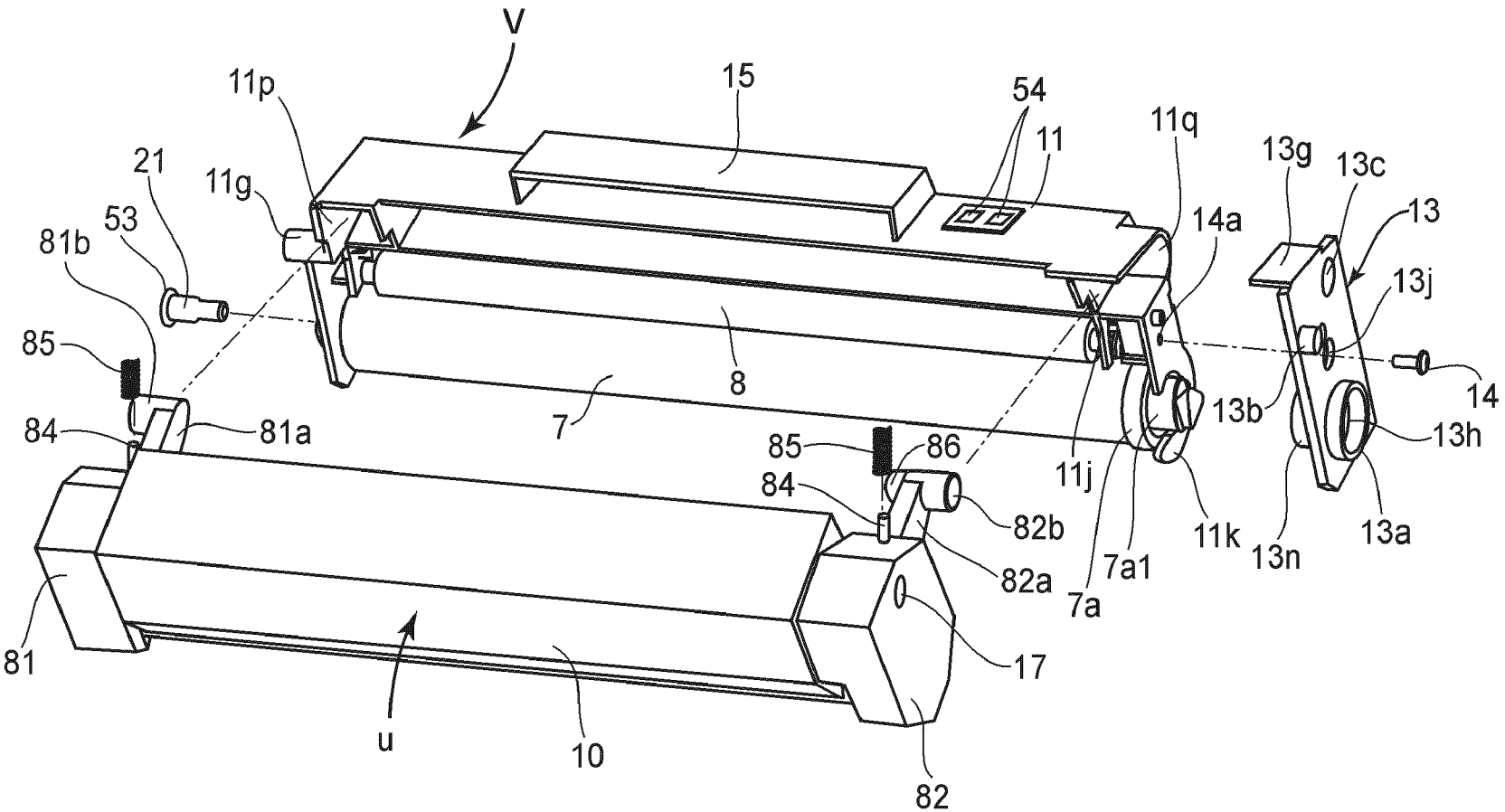
FIG. 6 is a partially exploded perspective view of the cartridge, showing the photosensitive member unit, development unit, and supporting members.
Figure 7A:
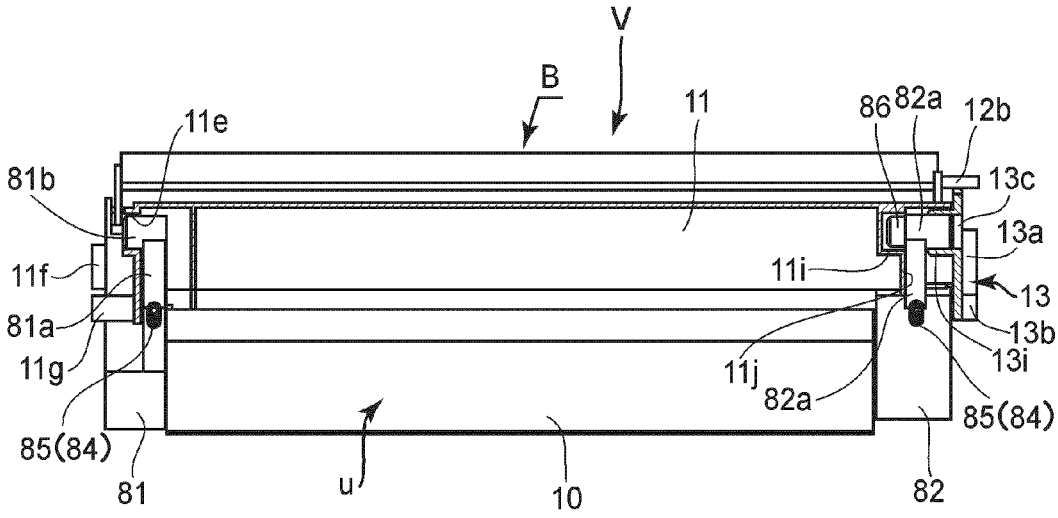
FIG. 7A is a schematic drawing of the cartridge, showing how the photosensitive drum unit, development unit, and supporting members are put together.
Figure 7B:
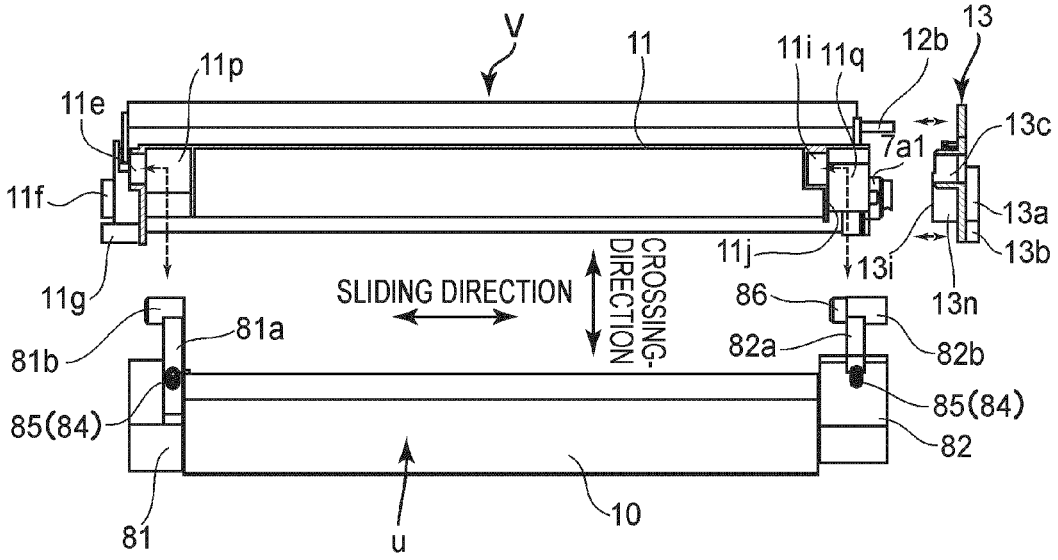
FIG. 7B is also a schematic drawing of the cartridge, showing how the photosensitive drum unit, development unit, and supporting members are put together.
Figure 8:
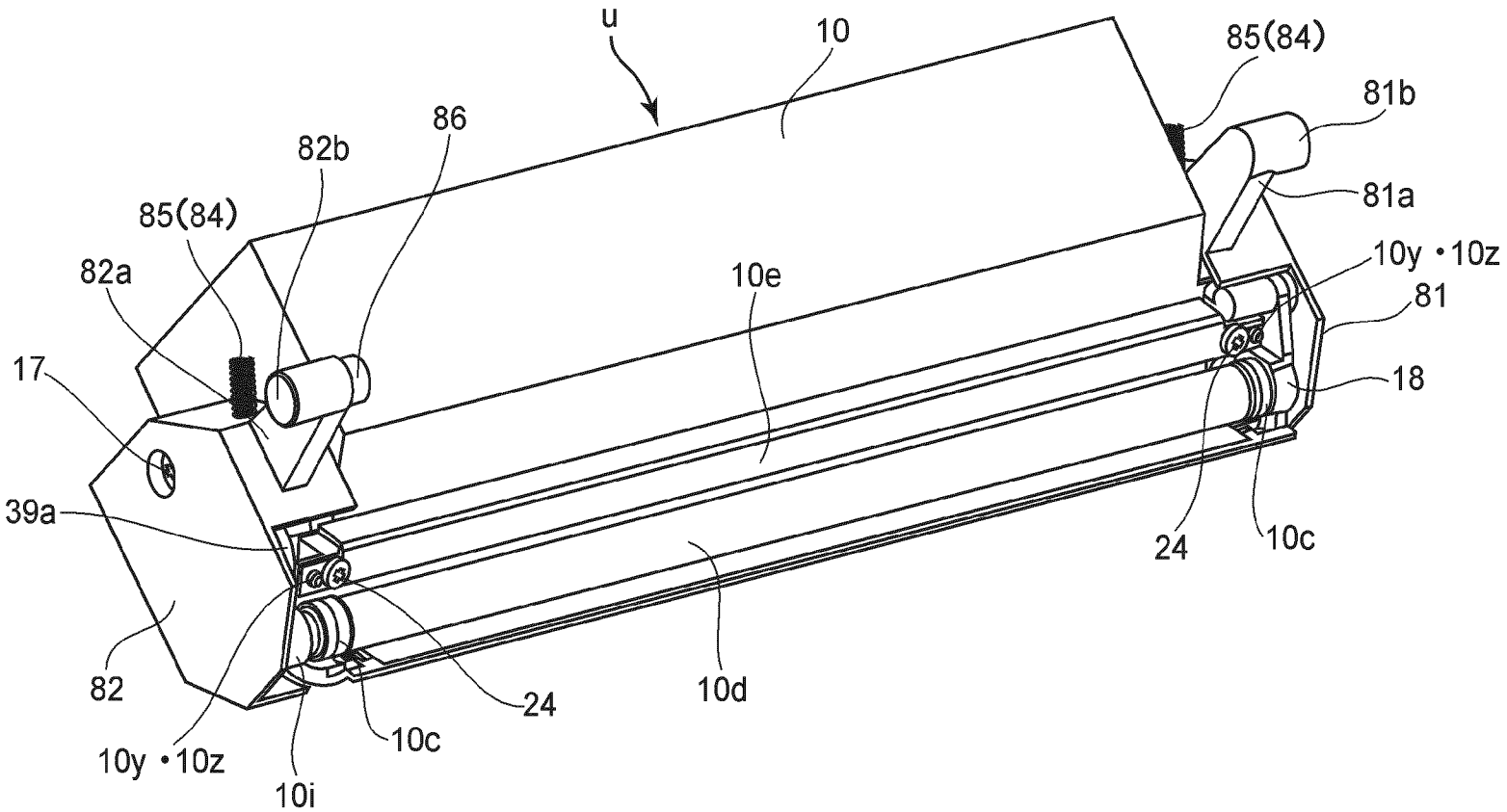
FIG. 8 is a perspective view of the development roller side of the development unit as seen from the side from which the development roller is driven.
Figure 9:
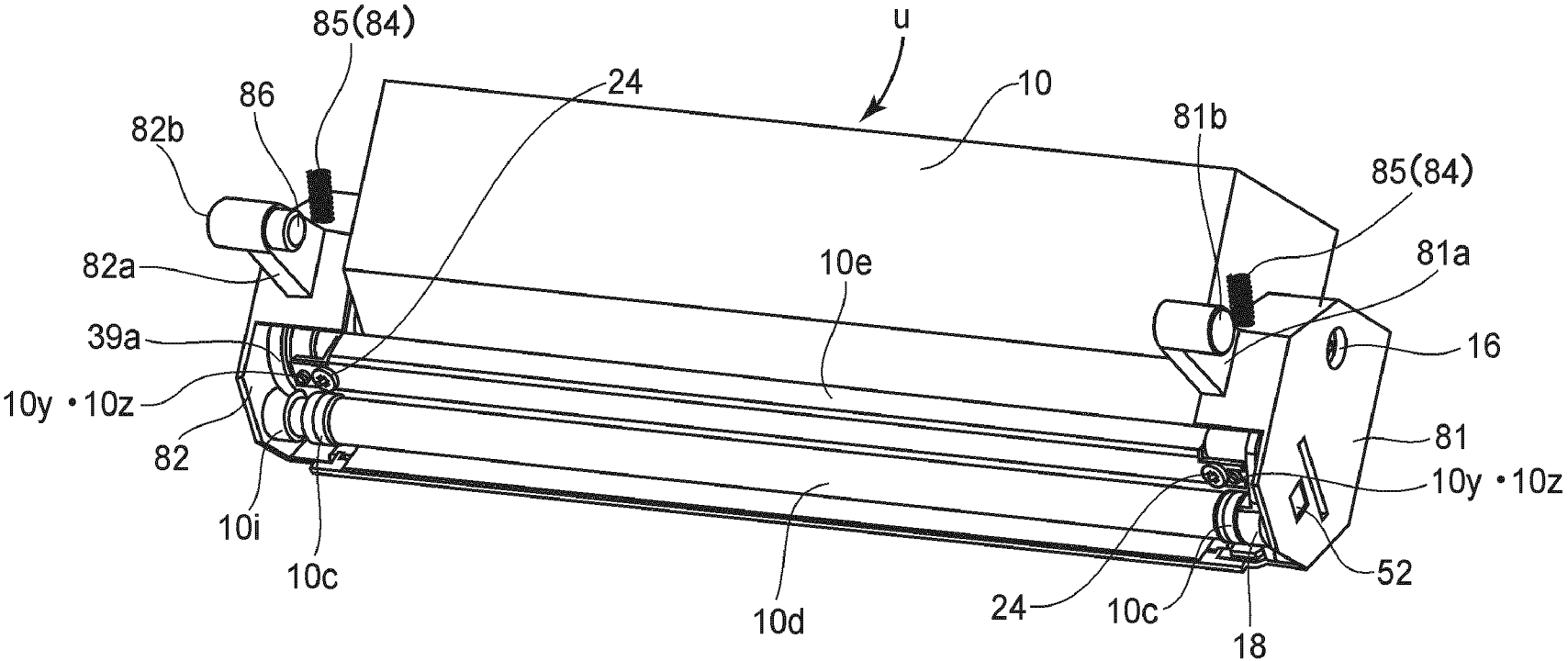
FIG. 9 is a perspective view of the development roller side of the development unit as seen from the opposite side from the side from which the development roller is driven.
Figure 10B:
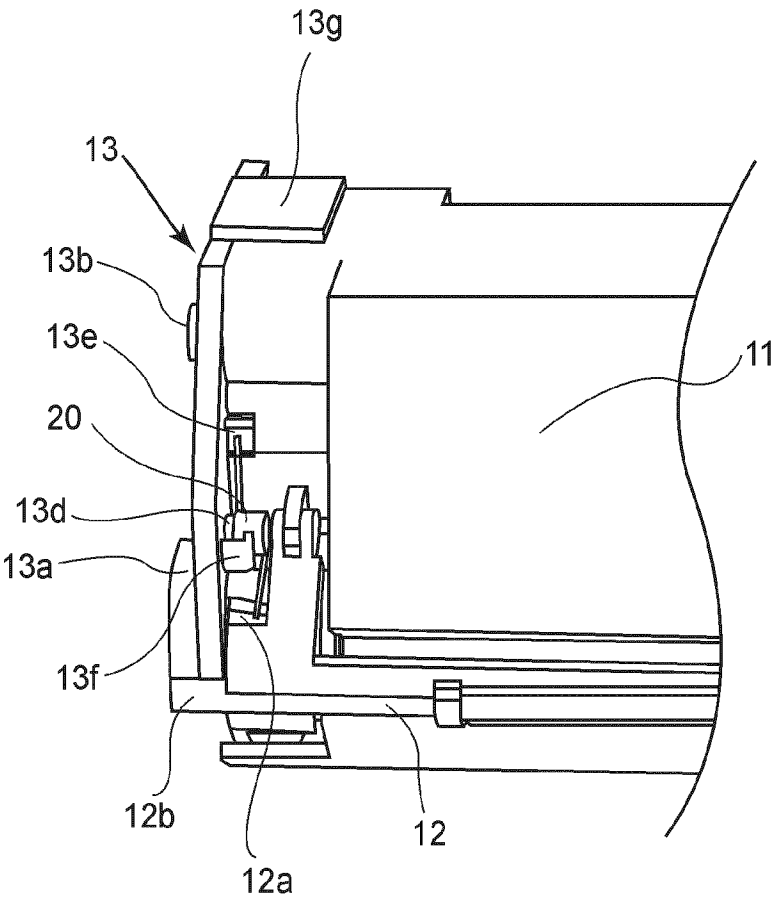
FIG. 10B is a perspective view of the supporting member portion and protective shutter portion of the cartridge B.
Figure 10A:
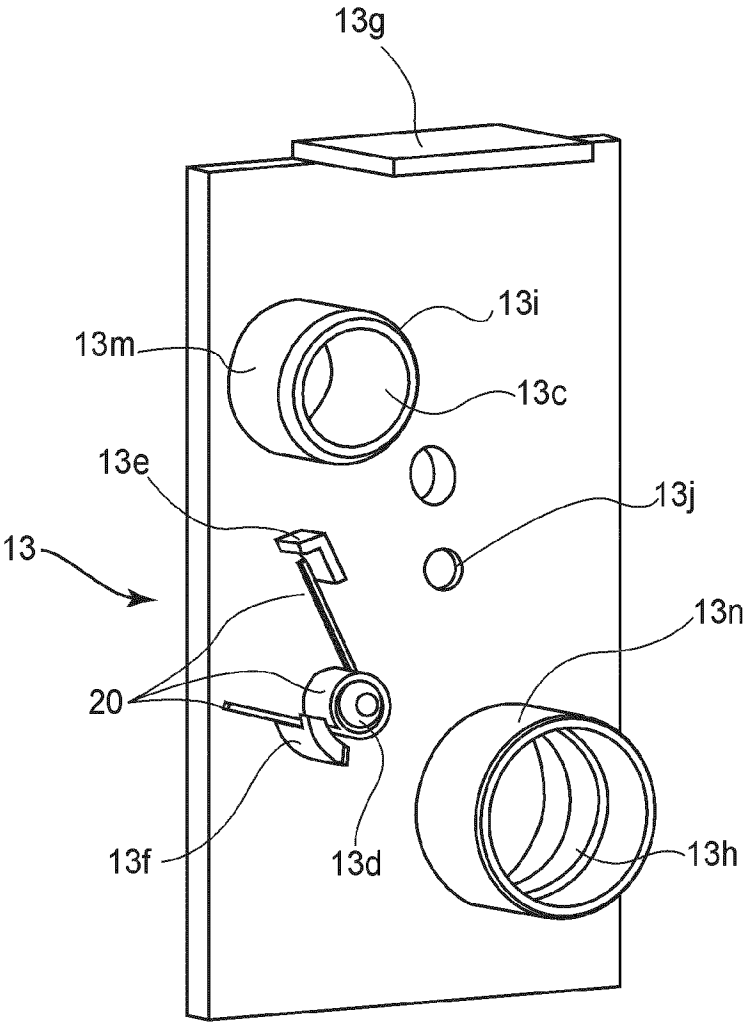
FIG. 10A is a perspective view of the supporting member as seen from its inward side.

FIG. 3 is a perspective view of the cartridge B as seen from one of the lengthwise ends of the cartridge B, more specifically, the lengthwise end from which the cartridge B is driven. FIG. 4 is a perspective view of the cartridge B as seen from the other lengthwise end of the cartridge B, that is, the lengthwise end from which the cartridge B is not driven. Hereafter, the lengthwise end of the cartridge B, from which the cartridge B is not driven, and the lengthwise end of the cartridge, from which the cartridge B is driven, will be referred to as the first and second lengthwise ends, respectively. FIG. 5 is a perspective view of the cartridge B after the separation of its supporting member 13 from the first lengthwise end of the cartridge B. FIG. 6 is a partially exploded perspective view of the cartridge B, showing the first unit v (photosensitive member unit), second unit u (development unit), supporting member 13, etc., into which the cartridge B has been separated. FIGS. 7A and 7B are schematic drawings of the first unit v, and second unit u, and supporting member 13, and show how the first unit v, second unit u, and supporting unit 13 are put together. FIG. 8 is a perspective view of the development roller side of the second unit u, as seen from the second lengthwise end of the second unit u. FIG. 9 is a perspective view of the development roller side of the second unit u, as seen from the first lengthwise end of the unit u. FIG. 10A is a perspective view of the supporting member 13 as seen from its inward side. FIG. 10B is a perspective view of the lengthwise end portion of the cartridge B, which has the supporting member 13, partially showing the supporting member 13 and protective shutter 12.

The cartridge B has the photosensitive member unit v (or the first unit), the development unit u (or the second unit), and supporting member 13.

The development unit u is provided with first and second lengthwise end holders 81 and 82, respectively, which are located at the lengthwise end of the development unit u, from which the cartridge B is not driven, and the other lengthwise end of the development unit u, respectively. The first and second lengthwise end holders 81 and 82 are provided with first and third columnar portions 81*b* and 82*b*, respectively, about which the development unit u rotationally moves. The columnar portions 81*b* and 82*b* fit in the first hole 11*e*, with which the frame 11 of the drum unit v is provided, and a second bearing 13*c*, with which the supporting member 13 is provided, respectively, to support the development unit u by the frame 11 of the photosensitive member unit v so that the development unit u and the photosensitive member unit v are allowed to rotationally move relative to each other in an oscillatory manner, and also, so that the two units can be connected without using connective pins or the like. Further, the position of the development unit u relative to the photosensitive member unit v in terms of its lengthwise direction is set by the supporting member 13. Moreover, the cartridge B can be easily disassembled by the removal of the supporting member 13.

The columnar portions 81*b* and 82*b* with which the development unit u is provided can be rotatably supported by the photosensitive member unit v and supporting member 13, making unnecessary additional components for connecting the development unit u and photosensitive member unit v to each other; the cartridge B is simpler in structure, and also, smaller in component count than a process cartridge in accordance with the prior art. Further, the removal of the supporting member 13 makes it possible to disassemble the cartridge B. Therefore, the cartridge B is superior to a cartridge in accordance with the prior art, in terms of the efficiency with which they are disassembled to recycle their essential components. Further, the cartridge B does not require connective pins or the like.

The photosensitive member unit v has the photosensitive member frame 11, the photosensitive drum 7, the charge roller 8, the cleaning blade 11*a*, the storage portion 11*c* for the removed developer, and a handgrip portion 15 for holding the cartridge B. The photosensitive drum 7 is rotatably supported at both of its lengthwise ends; the first lengthwise end of the photosensitive drum 7 is rotatably supported by the photosensitive drum unit frame 11, whereas the second lengthwise end of the photosensitive drum 7 is rotatably supported by the photosensitive drum unit frame 11, with the presence of a part of the supporting member 13 between the end of the photosensitive drum 7 and the photosensitive drum unit frame 11. The charge roller 8 is rotatably supported by its lengthwise ends; the first and second lengthwise ends of the charge roller 8 are rotatably supported by the first and second lengthwise ends of the photosensitive drum unit frame 11, respectively. The axial line of the photosensitive drum 7 is parallel to the axial line of the charge roller 8.

The development unit u has a development unit frame 10 and development roller 10*d*. The lengthwise ends of the development roller 10*d* are rotatably supported by the lengthwise ends of the development unit frame 10*d*, one for one, with the presence of the first and second lengthwise end holders 81 and 82 between the development roller 10*d* and the development unit frame 10, respectively.

The first and second lengthwise end holders 81 and 82 are attached to the lengthwise ends of the development unit frame 10, one for one, with the use of screws 16 and 17, respectively, and support the development roller 10*d*. In other words, the development unit frame 10 rotatably supports the development roller 10*d* at the lengthwise ends of the development roller 10*d*.

At the second lengthwise end of the cartridge B, the supporting member 13 and photosensitive unit frame 11 rotatably support the photosensitive drum 7 and the development unit u.

Next, the structure for connecting the development unit u to the photosensitive member unit v in a manner to support the development unit u with the photosensitive member unit v will be described. The development unit u has the development unit frame 10, and the first and second lengthwise end holders 81 and 82. The first and second lengthwise end holders 81 and 82 are attached to the first and second lengthwise ends of the development unit frame 10, with the use of screws 16 and 17, respectively.

Further, the first and second lengthwise end holders 81 and 82 are provided with first and second arm portions 81*a* and 82*a*, respectively. The first and second arm portions 81*a* and 82*a* project toward the photosensitive member unit v (in the direction intersecting the lengthwise direction of development unit frame 10). The end portion of the arm portion 81*a* is provided with the first columnar portion 81*b* (the supporting portion about which development unit u is allowed to rotationally move). The end portion of the arm portion 82*a* is provided with the third columnar portion 82*b* (supporting portion about which development unit u is allowed to rotationally move).

The photosensitive drum 7 is rotatably supported by the photosensitive drum unit frame 11. More specifically, the first lengthwise end of the photosensitive drum 7 is rotatably supported by a shaft 21 (drum shaft), with which the photosensitive drum unit frame 11 is provided to support the photosensitive member, whereas the other (second) lengthwise end of the photosensitive drum 7 is rotatably supported by the first bearing 13*h* (second supporting portion), of the supporting member 13. Also at the first lengthwise end, the drum shaft 21 is attached to the photosensitive drum unit frame 11; the drum shaft 21 is attached to the photosensitive drum unit frame 11 by being pressed into a hole 11*f*1 (FIG. 17) with which a first guiding portion 11*f* (FIG. 4), by which the process cartridge B is guided, is provided. The first guiding portion 11*f* is a part of the photosensitive drum unit frame 11, which is located at the first lengthwise end of the cartridge B. The supporting member 13 is at the second lengthwise end of the photosensitive drum unit frame 11, and is attached to the drum unit frame 11 with the use of a screw 14. Designated by reference characters 13*j* is the hole of the supporting member 13, through which the screw 14 is placed. Designated by reference characters 14*a* is the screw hole of the photosensitive drum unit frame 11, which accommodates the screw 14.

To summarize, the first lengthwise end of the photosensitive drum unit frame 11 is rotatably supported by the photosensitive drum unit frame 11 (which hereafter may be referred to simply as drum unit frame 11), whereas the other lengthwise end, that is, the second lengthwise end, is rotatably supported by the supporting member 13.

The abovementioned first lengthwise end of the drum frame 11 has the first hole 11*e*. The supporting member 13 has the second bearing 13*c* (which is first supporting portion). The first columnar portion 81*b* and third columnar portion 82*b* are fitted in the first hole 11*e* and the hole of the second bearing 13*c*, respectively. Thus, at the first lengthwise end, the wall of the first hole 11*e* rotatably supports the first columnar portion 81*b*, whereas at the second lengthwise end, the second bearing 13*c* rotatably supports the third columnar portion 82*b*, to allow the third columnar portion 82*b* to rotationally move in an oscillatory manner. The axial line of the first columnar portion 81*b* is in alignment with the axial line of the third columnar portion 82*b*, and the two axial lines are parallel to the axial line of the photosensitive drum 7. That is, at the second lengthwise end, the supporting member 13 supports the development unit frame 10 to allow the development unit frame 10 to rotationally move in an oscillatory manner. That is, the development unit u is supported by the photosensitive member unit v so that the former is allowed to rotationally move relative to the latter in an oscillatory manner. Further, at the second lengthwise end, the regulating portion 11*j*, with which the drum unit frame 11 is provided to regulate the movement of the development unit u in its lengthwise direction, and the arm catching portion 13*i* (FIGS. 7A and 7B), with which the supporting member 13 is provided to regulate the movement of the development unit u in its lengthwise direction, regulate the position (movement) of the second arm portion 82*a* in terms of the lengthwise direction, regulating thereby the position of the development unit u relative to the photosensitive member unit v in terms of their lengthwise direction.

The first and second lengthwise end holders 81 and 82, which are located at the first and second lengthwise ends, respectively, are provided with a pair of spring holding projections 84, one for one. A pair of compression springs 85, or pressure generating members, are fitted around the pair of spring holding projections 84, one for one, remaining compressed between the first lengthwise end holder 81 and drum unit frame 11, at the first lengthwise end, and between the second lengthwise end holder 82 and drum unit frame 11 at the second lengthwise end, respectively. Thus, the development unit u remains pressured in the direction to rotationally move about the first columnar portion 81*b* and third columnar portion 82*b* so that the development roller 10*d* is pressured toward the photosensitive drum 7. Thus, the spacer rings with which the lengthwise end portions of the development roller 10*d* are provided are kept in contact with the photosensitive drum 7, maintaining thereby a preset amount of gap α (FIG. 2) between the development roller 10*d* and photosensitive drum 7. That is, the first lengthwise end holder 81 and second lengthwise end holder 82 are fitted with the pair of springs 85, one for one, to keep the development roller 10*d* pressured toward the photosensitive drum 7 with the presence of the spacer rings between the development roller 10*d* and photosensitive drum 7.

With the employment of the above described structural arrangement in this embodiment, it is possible to support the development unit u by the photosensitive drum unit v, without using the connective pins or the like, to allow the development unit u to rotationally move relative to the photosensitive member unit v in an oscillatory manner. Further, at the second lengthwise end, both the photosensitive drum 7 and development unit u (third columnar portion 82*b*) are held by the supporting member 13. Therefore, the photosensitive drum 7, and the development roller 10*d* supported by the development unit u, are precisely positioned relative to each other.

Further, in order to transmit a driving force to the photosensitive drum 7 from the driving force outputting portion (unshown) of the apparatus main assembly A, the second lengthwise end of the photosensitive drum 7 is fitted with a drum gear 7*a* (FIG. 6). Further, in order to transmit to the development roller 10*d*, the driving force from the apparatus main assembly A, the second lengthwise end of the development roller 10*d*, in terms of its lengthwise direction, is fitted with a development roller gear 10*i* (FIGS. 8 and 9). Further, in order to transmit the driving force from the development roller gear 10*i* to the gear 39*b* (FIGS. 19 and 20) of a rotatable developer conveying member 39 (FIGS. 1 and 2) located in the developer storage portion 10*f* of the development unit frame 10, the development unit u is provided with an idler gear 39*a*, which is attached to the second lengthwise end of the development roller 10*d*. Further, the second lengthwise end holder 82 covers the gear train made up of the development roller gear 10*i*, the developer conveying member gear 39*b*, and the idler gear 39*a*.

Further, in order to input a charge bias into the charge roller 8 from the charge bias outputting portion (unshown) of the apparatus main assembly A, the drum unit frame 11 is provided with a charge bias contact 51 (FIG. 4), which is in the form of an electrode, and is on the outward surface of the first lengthwise end wall of the drum unit frame 11. The charge bias contact 51 is in contact with the metallic core of the charge roller 8, which is electrically conductive.

Further, in order to input a development bias into the development roller 10*d* from the development bias outputting portion (unshown) of the apparatus main assembly A, the first lengthwise end holder 81 is provided with a development bias contact 52, which is in the form of an electrode and is on the outward surface of the first lengthwise end holder 81. There is an electrical connection between this electrical contact 52 and the electrically conductive substrate of the development roller 10*d*, through a development roller bearing 18 (FIG. 19), which is electrically conductive.

Further, in order to ground the photosensitive drum 7, the drum shaft 21, which is attached to the second lengthwise end of the drum unit frame 11 to support the photosensitive member supporting portion, is made of an electrically conductive metallic substance or the like so that the drum shaft 21 can double as a drum grounding electrical contact 53. There is provided an electrical contact between the drum shaft 21 and the substrate of the photosensitive drum 7.

Further, the cartridge B is provided with a memory tag, which makes it possible for the various information regarding the cartridge B, for example, the number of recording media 2 conveyed through the apparatus main assembly A, to be exchanged (read from or written into) between the control circuit portion (unshown) of the apparatus main assembly A and the cartridge B. The drum unit frame 11 is provided with an electrical contact 54 for the memory tag.

(Structure of Means for Guiding Cartridge B)

Figure 11:
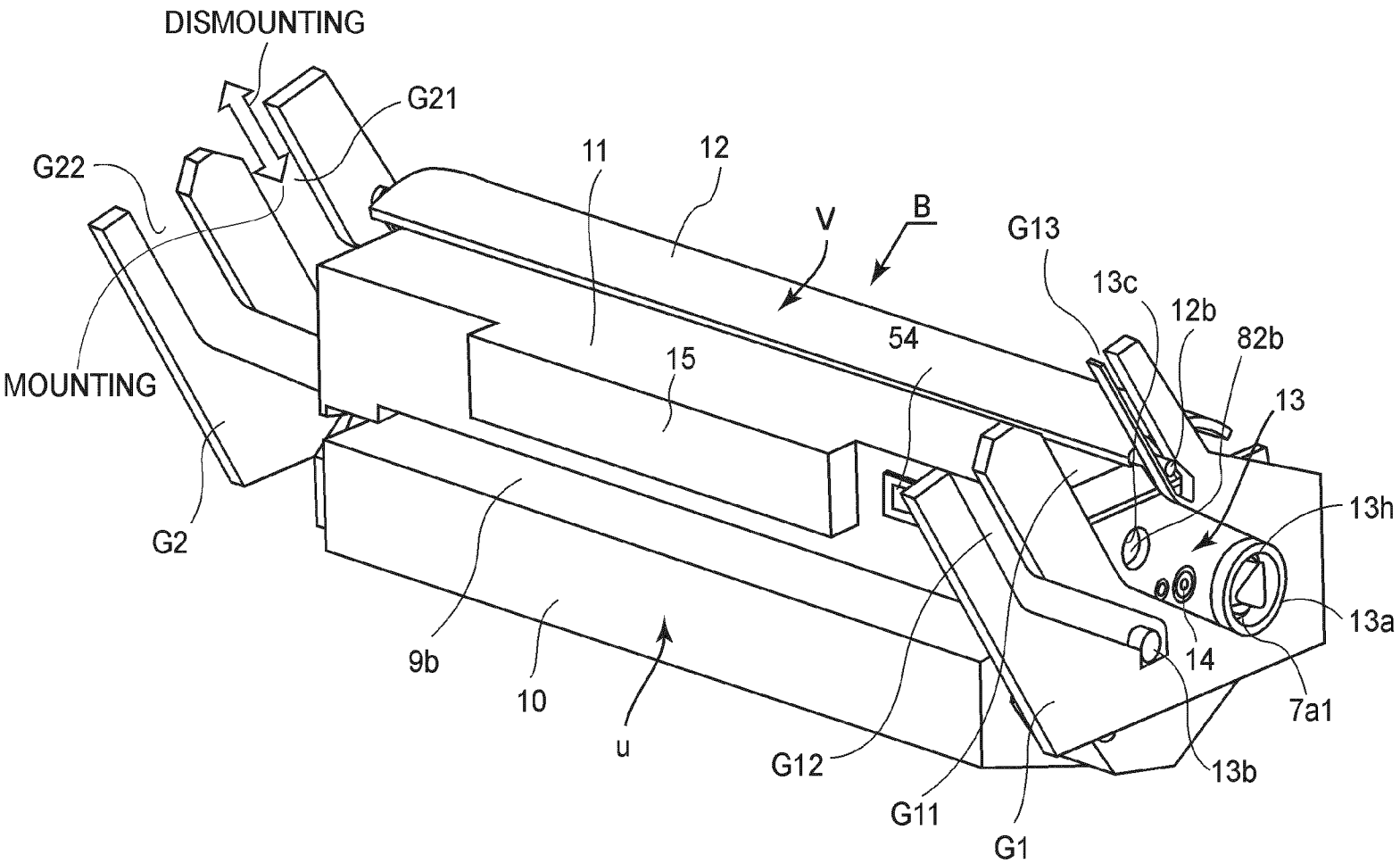
FIG. 11 is a perspective view of the cartridge in the main assembly of the image forming apparatus, and the cartridge guiding members of the main assembly of the image forming apparatus, as seen from the side from which the cartridge is driven.
Figure 12:
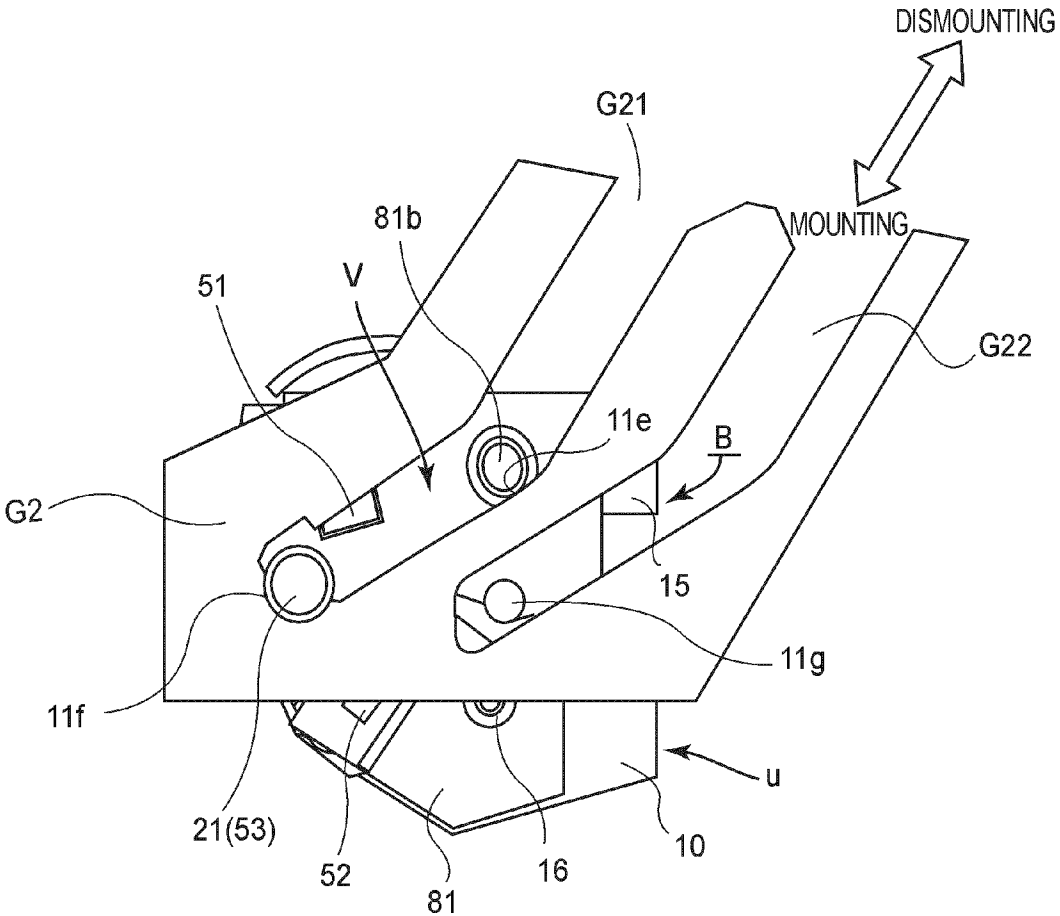
FIG. 12 is a side view of the cartridge in the main assembly of the image forming apparatus, and the cartridge guiding member of the main assembly, as seen from the opposite side from the side from which the cartridge is driven.

Next, referring to FIGS. 11 and 12, the means for guiding the cartridge B when the cartridge B is mounted into, or removed from, the apparatus main assembly A will be described regarding their structure. FIG. 11 is a perspective view of the combination of the cartridge B and the cartridge guiding members G1 and G2 of the main assembly A, as seen from the second lengthwise end (from which cartridge B is driven), when the cartridge B is in its image forming position in the apparatus main assembly A. FIG. 12 is a side view of the combination of the cartridge B and the cartridge guiding member G2, as seen from the first lengthwise end side (from which cartridge B is not driven), when the cartridge B is in its image forming position in the apparatus main assembly A.

The cartridge B is provided with guiding means by which the cartridge B is guided when a user mounts the cartridge B into the apparatus main assembly A or removes it therefrom. The guiding means are made up of the first cartridge guiding portion 11*f*, a second cartridge guiding portion 11*g*, a third cartridge guiding portion 13*a*, and a fourth cartridge guiding portion 13*b*. The first and third cartridge guiding portions 11*f* and 13*a* double as cartridge positioning portions, whereas the second and fourth cartridge guiding portions double as cartridge rotation regulating portions. They are on the lengthwise end surfaces of the cartridge B. More specifically, in terms of the lengthwise direction of the cartridge B, the first and second cartridge guiding portions 11*f* and 11*g* are at the first lengthwise end of the drum unit frame 11, whereas the third and fourth cartridge guiding portions 13*a* and 13*b* belong to the supporting member 13. The apparatus main assembly A is provided with the abovementioned cartridge guides G1 and G2 which guide the cartridge guiding portions 11*f*, 11*g*, 13*a*, and 13*b* of the cartridge B.

The first and third cartridge guiding portions 11*f* and 13*a* are columnar (circular in cross section), and project outward from the end surfaces of the photosensitive member unit v, one for one. Further, the axial line of the first guiding portions 11*f* and the axial line of the third cartridge guiding portion 13*a* are in alignment with the axial line of the photosensitive drum 7. The second and fourth cartridge guiding portions 11*g* and 13*b* also project outward from the lengthwise end surfaces of the photosensitive member unit v, one for one. When the cartridge B is mounted into the apparatus main assembly A, the first and second cartridge guiding portions 11*f* and 11*g* of the cartridge B are guided by the grooves G21 and G22 of the guide G2 of the apparatus main assembly A, respectively, and the third and fourth cartridge guiding 13*a* and 13*b* of the cartridge B are guided by the grooves G11 and G12 of the guide G1 of the apparatus main assembly A, respectively. Therefore, when the cartridge B is mounted into the apparatus main assembly A, it is properly guided into its image forming position in the apparatus main assembly A. As the cartridge B is moved into its image forming position, the first and third cartridge guiding 11*f* and 13*a*, the axial line of which are in alignment with the axial line of the photosensitive drum 7, are precisely positioned relative to the apparatus main assembly A while allowing the cartridge B to rotationally move about them. The fourth cartridge guiding portion 13*b*, which doubles as the cartridge rotation regulating portion, comes into contact with the walls of the groove G11 of the guide G1, regulating thereby the rotation of the cartridge B. Therefore, the cartridge B is fixed in its attitude in the apparatus main assembly A.

When a user mounts the cartridge B into the apparatus main assembly A, the protective shutter guiding portion 12*b* of the protective shutter 12, which is at the first lengthwise end of the cartridge B in terms of the lengthwise direction of the cartridge B, is guided by the groove G13 of the cartridge guide G1 of the apparatus main assembly A. Thus, as the cartridge B is moved into the apparatus main assembly A, the protective shutter 12 is rotationally opened against the resiliency of the spring 20 (FIG. 10) for keeping the protective shutter 12 closed. More concretely, as the cartridge B is moved into the apparatus main assembly A, the protective shutter 12 is rotationally moved into the position, outlined with a solid line in FIG. 2, in which it leaves the photosensitive drum 7 exposed from the cartridge B in a preset manner. After the completion of the mounting of the cartridge B into the apparatus main assembly A, the protective shutter 12 is kept in the abovementioned photosensitive drum exposing position. Next, referring to FIG. 15, as the cartridge B is moved in the direction to remove the cartridge B from the apparatus main assembly A, the protective shutter 12 is rotationally moved by the spring 20, back into the cartridge protecting position, in which it keeps the photosensitive drum 7 completely covered.

Toward the end of the process of mounting the cartridge B into the apparatus main assembly A, the driving force outputting portion of the apparatus main assembly A becomes engaged with the driving force receiving portion of the cartridge B. Further, the electrical contact of the charge bias outputting portion and the electrical contact of the development bias outputting portion of the apparatus main assembly A become electrically connected to the charge bias contact 51 and development bias contact 52 of the cartridge B, respectively. Also, the ground contact of the apparatus main assembly A becomes electrically connected to the drum grounding contact 53 of the cartridge B. Further, the communicational electrical contact of the apparatus main assembly A becomes electrically connected to the electrical contact 54 of the memory tag of the cartridge B.

(Developer Seal)

Figure 13:
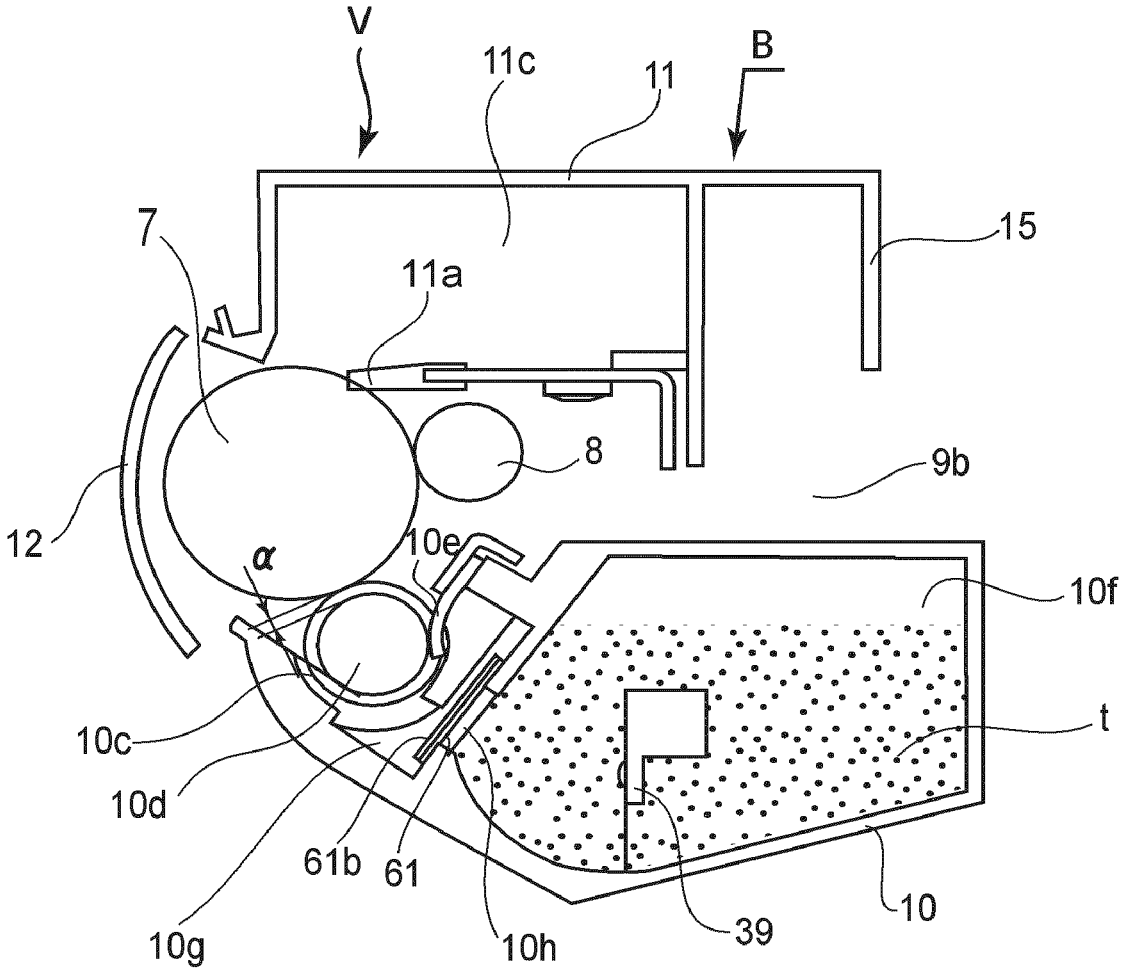
FIG. 13 is a sectional view of the cartridge, the developer outlet of which is sealed with a developer seal (sealing member).
Figure 14:
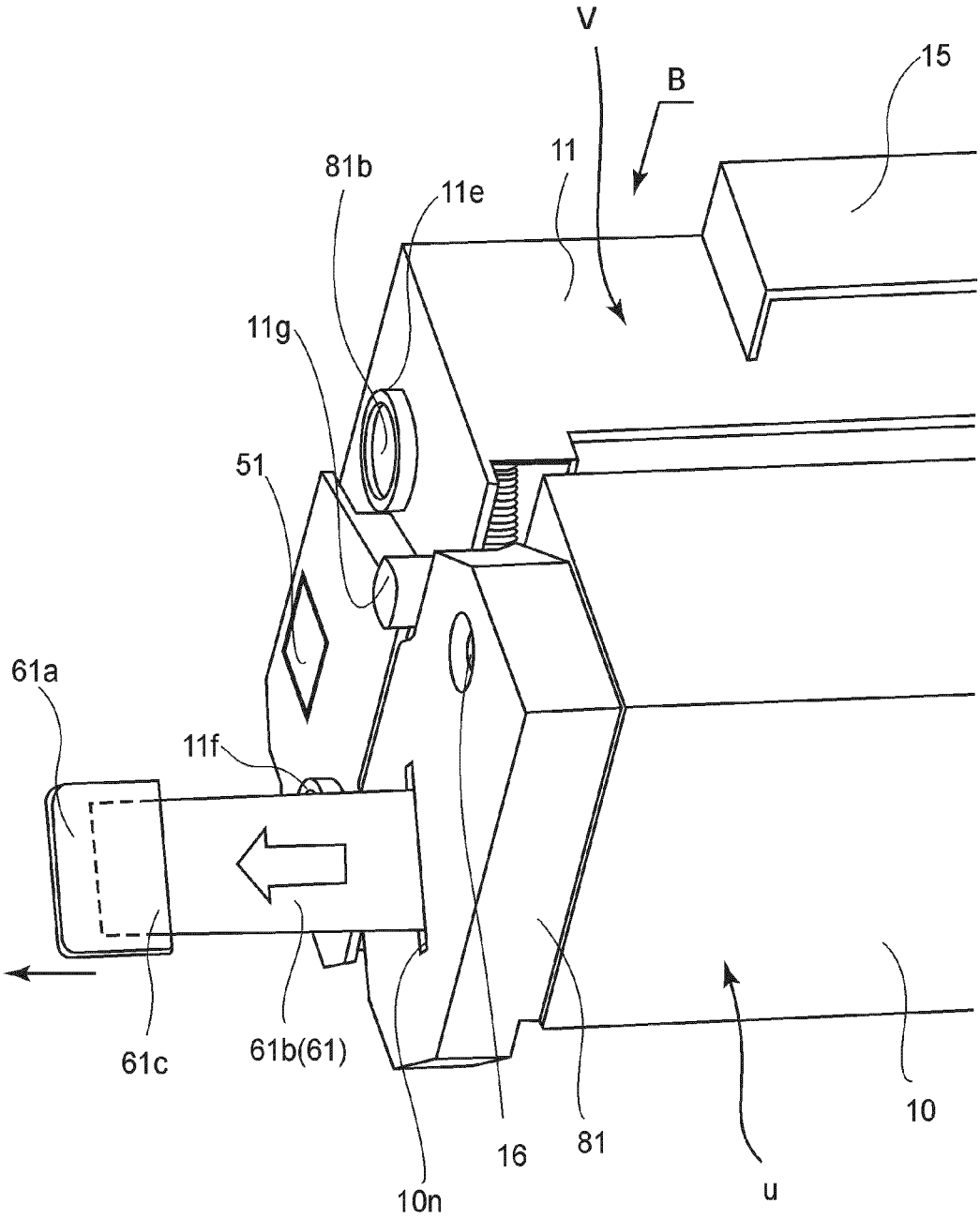
FIG. 14 is a perspective view of one of the lengthwise ends of the cartridge, from which the developer seal is being pulled out.

Referring to FIG. 13, when a brand-new cartridge B is shipped out of the factory, the opening of the developer outlet 10*h* of the cartridge B, which allows the developer t in the developer storage portion 10*f* of the development unit frame 10, to be supplied to the development roller 10*d*, remains sealed with a flexible developer seal 61 (sealing member). That is, the cartridge B contains a preset amount of developer t, which is only in the developer storage portion 10*f*. In other words, before the cartridge B is used for the first time, there is no developer t in the developing portion 10*g* having the development roller 10*d*.

Figure 15:
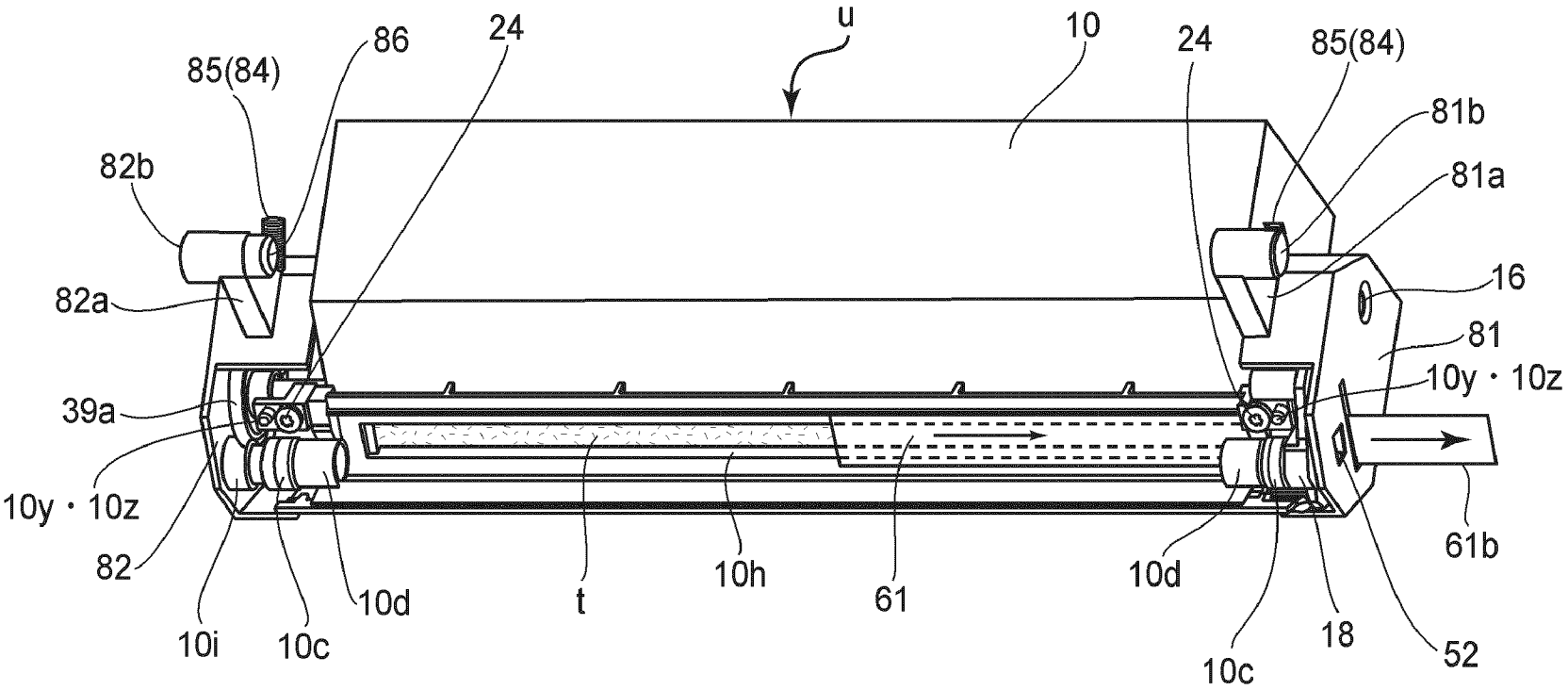
FIG. 15 is a perspective view of the cartridge, as seen from its development roller side, showing how the developer outlet opening is exposed as the developer seal is peeled away from the developer outlet.
Figure 16:
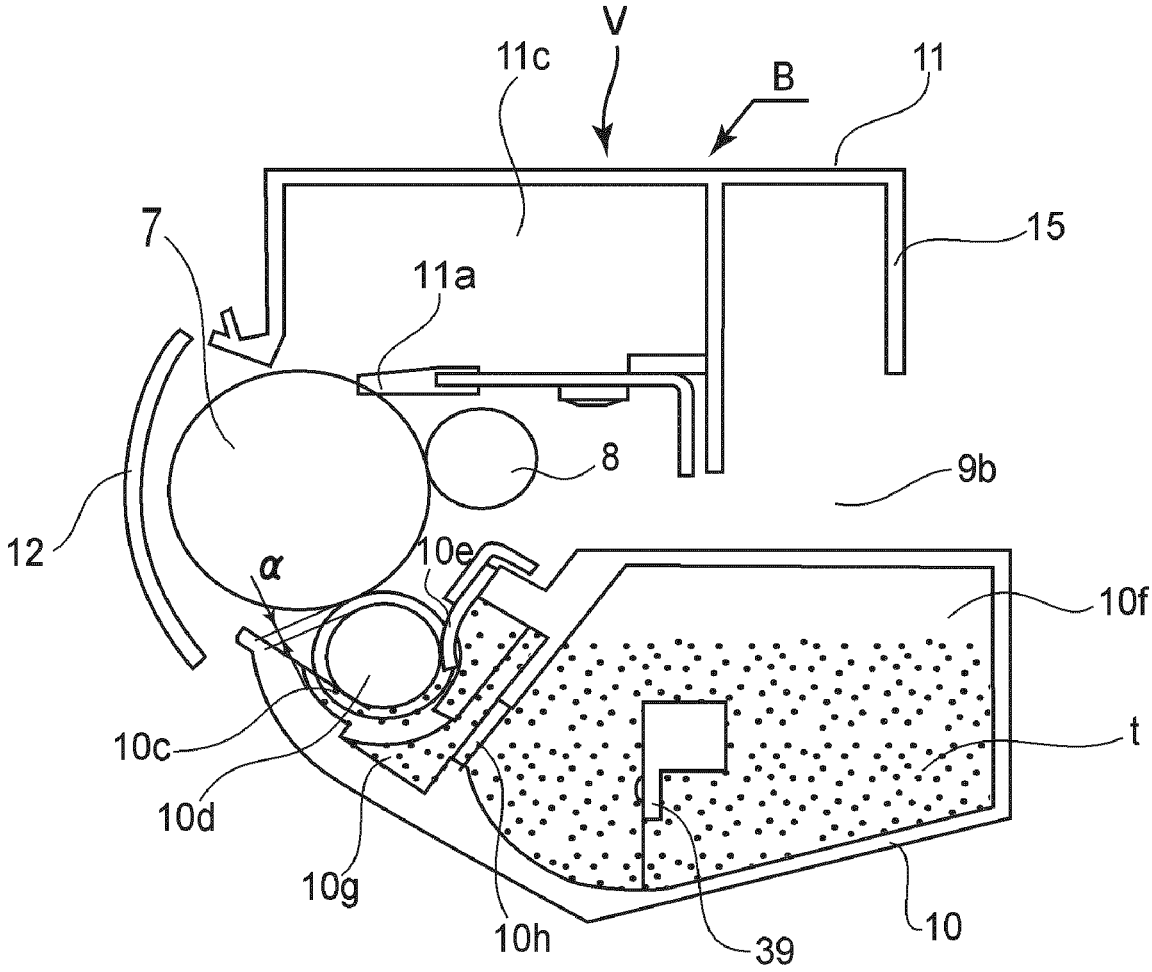
FIG. 16 is a sectional view of the cartridge in which the developer has flowed into the latent image developing portion from the unsealed developer storage portion.

Referring to FIG. 4, before a user uses a brand-new cartridge B, the user is to pull out the developer seal from the cartridge B to allow the developer t in the developer storage portion 10*f* to flow into the developing portion 10*g* as shown in FIG. 16. More specifically, the opening of the developer outlet 10*h* is sealed with the developer seal 61. The developer seal 61 is extended from the lengthwise end of the opening of the developer outlet 10*h*, which is located at the first lengthwise end of the cartridge B, to the other, is folded back there toward the first lengthwise end, and is extended further beyond the first lengthwise end so that it is exposed from the cartridge B through the developer seal removal slit 10*n* of the development unit u. The end of the outward extension 61*b* of the developer seal 61 is provided with a pull-tab 61*a* (tab for removing developer seal 61). The tab 61*a* is pasted to the end of the outward extension 61*b* of the developer seal 61. As the tab 61*a* is pulled by the user, the developer seal 61 is pulled outward, being thereby peeled away from the developer outlet 10*h*, or torn in a manner to expose the opening of the developer outlet 10*h*. As a result, the developer seals 61 completely comes out of the cartridge B. FIG. 15 shows that as the tab 61*a* is pulled, the developer seal 61 is peeled away from the developer outlet 10*h* to unseal the developer outlet 10*h*. The developer seal 61 is removed from the cartridge B by being completely pulled out of the cartridge B. As the developer seal 61 is completely pulled out of the cartridge B, the developer outlet 10*h* is unsealed across its entire range, allowing therefore the developer t in the developer storage portion 16*f* to flow into the developing portion 10*g*.

As described above, the brand-new cartridge B is mounted into the apparatus main assembly A after its developer outlet 10*h* is unsealed by removing the developer seal 61. The developer seal removal slit 10*n* is provided with a developer leak prevention seal (unshown).

(Process Cartridge Remanufacturing Method)

The cartridge B is mounted into the apparatus main assembly A to be used for image formation. As the cartridge B is used for image formation, the developer t in the developer storage portion 10*f* is consumed. Thus, as the cartridge B is repeatedly used for image formation, the amount of the developer t in the developer storage portion 10*f* becomes so small that it is impossible to form an image which is satisfactory in quality to a user of the cartridge B. Thus, there is provided a means (unshown) for detecting the amount of the developer remaining in the cartridge B to compare the detected amount of the developer remainder with a threshold value preset for informing or warning a user of the remaining amount of the service life of the cartridge B, in the control circuit portion (unshown) of the apparatus main assembly A. If it is determined that the detected amount of the remaining developer is smaller than the threshold value, the prediction or warning regarding the remaining amount of the service life of the cartridge is displayed on the display portion (unshown), in order to prompt the user to prepare a replacement cartridge or to replace the cartridge B in the apparatus main assembly A to ensure that the image forming apparatus remains at a preset level in terms of image quality.

As a cartridge B is depleted of the developer t, it is recovered to be remanufactured. That is, it is cleaned, or its worn or damaged components, etc., are replaced. Then, it is refilled with a fresh supply of developer so that it can be reused. Hereafter, the method for remanufacturing a cartridge depleted of developer will be described.

(a) Removal of Supporting Member 13

Referring to FIG. 5, the screw 14, with which the supporting member 13 is held to the drum unit frame 11 at the second lengthwise end of the cartridge B, is removed. The screw 14 is an ordinary screw, and therefore, can be removed by an ordinary tool. Next, the first bearing 13*h* of the supporting member 13, is removed from the shaft 7*a*1, which is located at the second lengthwise end of the photosensitive drum 7. Further, the second bearing 13*c*, of the supporting member 13, is removed from the third columnar portion 82*b*. Then, the supporting member 13 is removed from the drum unit frame 11. The first bearing 13*h* is the inward portion of the first columnar portion 81*b* (FIG. 10A) which perpendicularly projects from the inward side of the supporting member 13. The peripheral surface of a columnar portion 13*n* is in contact with the wall of a hole 11*k* (FIGS. 17 and 18) of the drum unit frame 11, which has a C-shaped cross section. The second bearing 13*c* is the inward portion of the second columnar portion 13*m* (FIG. 10A) which perpendicularly projects from the inward surface of the supporting member 13.

That is, the removal of the supporting member 13 causes the second bearing 13*c* to separate from the third columnar portion 82*b*, and the first bearing 13*h* to separate from the shaft 7*a*1 of the photosensitive drum 7. As a result, the second columnar portion 82*b* fits into the second hole 11*i* so that the development unit frame 10 is temporarily supported by the drum unit frame 11 at the second lengthwise end. That is, the development unit frame 10 is positioned relative to the drum unit frame 11 so that the second bearing 13*c* and first bearing 13*h* are enabled to support the third columnar portion 82*b* and shaft 7*a*1, respectively. Therefore, it becomes possible for the photosensitive member unit v (drum unit frame 11) and development unit u (development unit frame 10) to be separated from each other.

That is, at the second lengthwise end, the second bearing 13*c* is separated from the third columnar portion 82*b*, and the first bearing 13*h* is separated from the shaft 7*a*1 of the photosensitive drum 7. Then, the second columnar portion 86 is fitted into the second hole 11*i* to temporarily support the development unit frame 10 by the drum unit frame 11. That is, the development unit frame 10 is positioned in its normal position shown in FIG. 7A, enabling the photosensitive member unit v (drum unit frame 11) and development unit u (development unit frame 10) to be separated from each other. In other words, the supporting member 13 is removed from the drum unit frame 11 by removing the screw 14, and the photosensitive member unit v and development unit u of the cartridge B can be easily separated from each other by removal of the supporting member 13 from the drum unit frame 11.

(b) Frame Separation

Next, the development unit frame 10 is to be slid along the drum unit frame 11 toward the second lengthwise end (in its lengthwise direction) so that the first columnar portion 81*b* is moved out of the first hole lie at the first lengthwise end, and the second columnar portion 86 is moved out of the second hole 11*i* at the second lengthwise end. Then, the development unit frame 10 is separated from the drum unit frame 11 in the direction intersecting the direction perpendicular to the lengthwise direction of the drum unit frame 11 so that the first and second arm portions 81*a* and 82*a* of the development unit frame 10 are pulled out of recesses 11*p* and 11*q*, with which the first and second lengthwise end portions of the drum unit frame 11 are provided, respectively. The execution of the above described steps separates the cartridge B into three essential sections, that is, the drum unit frame 11 (photosensitive member unit v), the development unit frame 10 (development unit u), and the supporting member 13, as shown in FIG. 7B.

As described above, the removal of the supporting member 13 makes it possible for the development unit frame 10 to be slide in its lengthwise direction along the drum unit frame 11, enabling thereby the drum unit frame 11 and the development unit frame 10 to be separated from each other. That is, the drum unit frame 11 and the development unit frame 10 can be easily separated from each other by the removal of only the supporting member 13.

Figure 17:
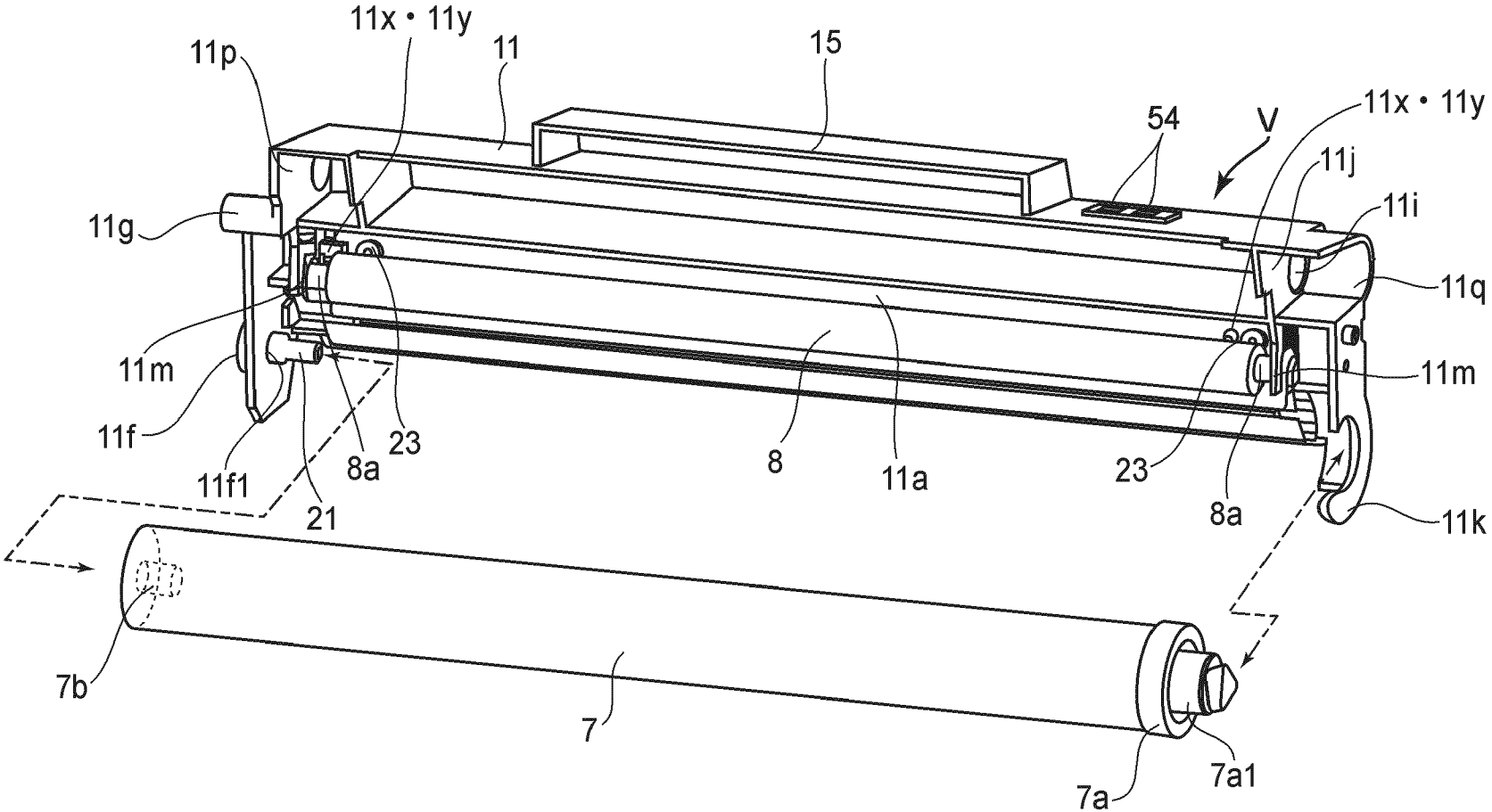
FIG. 17 is a partially exploded view of the cartridge after the removal of the photosensitive drum from the photosensitive drum unit frame.
Figure 18:
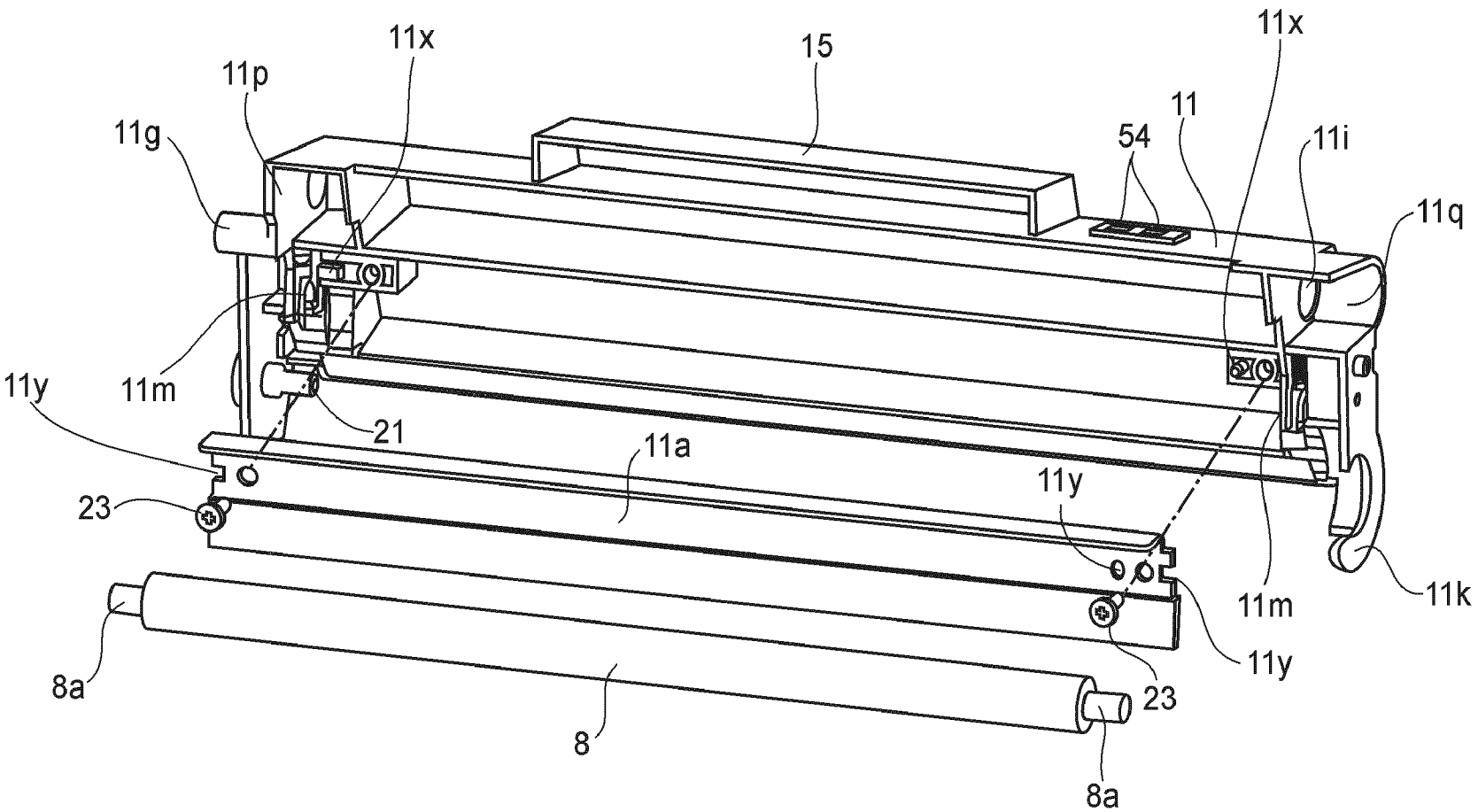
FIG. 18 is a partially exploded view of the cartridge after the removal of the charge roller and cleaning blade from the photosensitive drum unit frame.

(c) Disassembly of Drum Unit, Cleaning and Replacement of Drum Unit Components, and Reassembly of Drum Unit After the separation of the drum unit v from the development unit u, the drum unit v is disassembled. FIG. 17 is a perspective view of the photosensitive drum unit v, the photosensitive drum 7 of which has been separated from the rest. FIG. 18 is a perspective view of the photosensitive drum unit v, from which the charge roller 8 and cleaning blade 11*a* have been removed in addition to the photosensitive drum 7.

The photosensitive drum 7 is supported by the drum unit frame 11. More specifically, the shaft 21, with which the first lengthwise end portion of the drum unit frame 11 is provided, is fitted in the hole 7*b* of the photosensitive drum 7, with which the first lengthwise end portion of the photosensitive drum 7 is provided, and the shaft 7*a*1 with which the second lengthwise end portion of the photosensitive drum 7 is provided, is fitted in the hole 11*k* of the second lengthwise end portion of the drum unit frame 11, which is C-shaped in cross section. Thus, the photosensitive drum 7 can be removed from the drum unit frame 11 by removing the shaft 7*a*1 located at the second lengthwise end, from the hole 11*k* which is C-shaped in cross section, and pulling out the shaft 21 located at the first lengthwise end, from the hole 7*b* of the photosensitive drum 7, as shown in FIG. 17.

As described above, as the supporting member 13 is removed from the drum unit frame 11, the photosensitive drum supporting portion 7*a*1 (shaft) located at the second lengthwise end is exposed. Therefore, the photosensitive drum 7 can be easily removed from the drum unit frame 11 after the separation of the drum unit frame 11 and development unit frame 10 from each other.

Further, the charge roller 8 can be removed from the drum unit frame 11 by disengaging the end portions 8*a* of the shaft of the charge roller 8, which are located at the first and second lengthwise ends, respectively, from the corresponding bearings 11*m*, with which the first and second lengthwise end portions of the drum unit frame 11 are provided, respectively.

As for the removal of the cleaning blade 11*a*, the cleaning blade 11*a* is secured to the drum unit frame 11 with the use of a pair of screws 23 after the cleaning blade 11*a* is positioned relative to the drum unit frame 11 by placing the cleaning blade 11*a* in such a manner that the cleaning blade positioning small projections, with which the drum unit frame 11 is provided, fit into the cleaning blade positioning holes or slits, with which the cleaning blade 11*a* is provided. Therefore, the removal of the screws 23 allows the cleaning blade 11*a* to be removed.

After the removal of the photosensitive drum 7, charge roller 8, and cleaning blade 11*a*, the drum unit frame 11 is cleaned. If necessary, the charge roller 8 and cleaning blade 11*a* are also cleaned. As for the methods for cleaning them, there are vacuuming, blowing, rinsing, and wiping, for example.

Then, the drum unit v (photosensitive member unit v) is reassembled following in reverse the above described steps for disassembling the drum unit v. That is, the cleaning blade 11*a*, the charge roller 8, and the photosensitive drum 7 are attached to the drum unit frame 11 in the listed order. In this embodiment, it is a brand-new photosensitive drum 7 that is attached to the drum unit frame 11. In order to attach the first lengthwise end portion of the photosensitive drum 7 to the first lengthwise end of the drum unit frame 11, the shaft 21 is inserted into the hole 7*b* of the photosensitive drum 7 to support the photosensitive drum 7 at the first lengthwise end. At the second lengthwise end, the shaft 7*a*1 is fitted into the hole 11*k*, which is C-shaped in cross section, to support the photosensitive drum 7 at the second lengthwise end.

Figure 19:
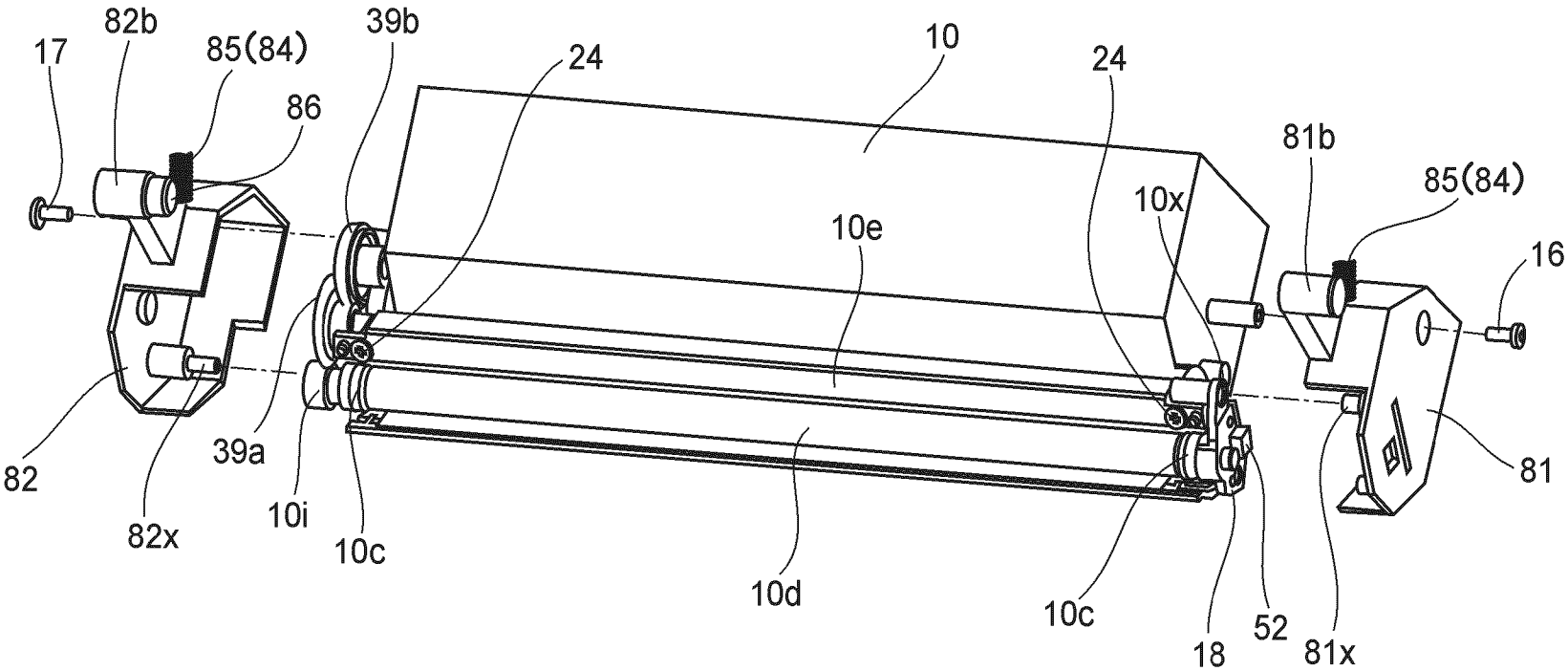
FIG. 19 is a partially exploded perspective view of the development unit after the removal of the holders from the lengthwise ends of the development unit frame, one for one.
Figure 20:
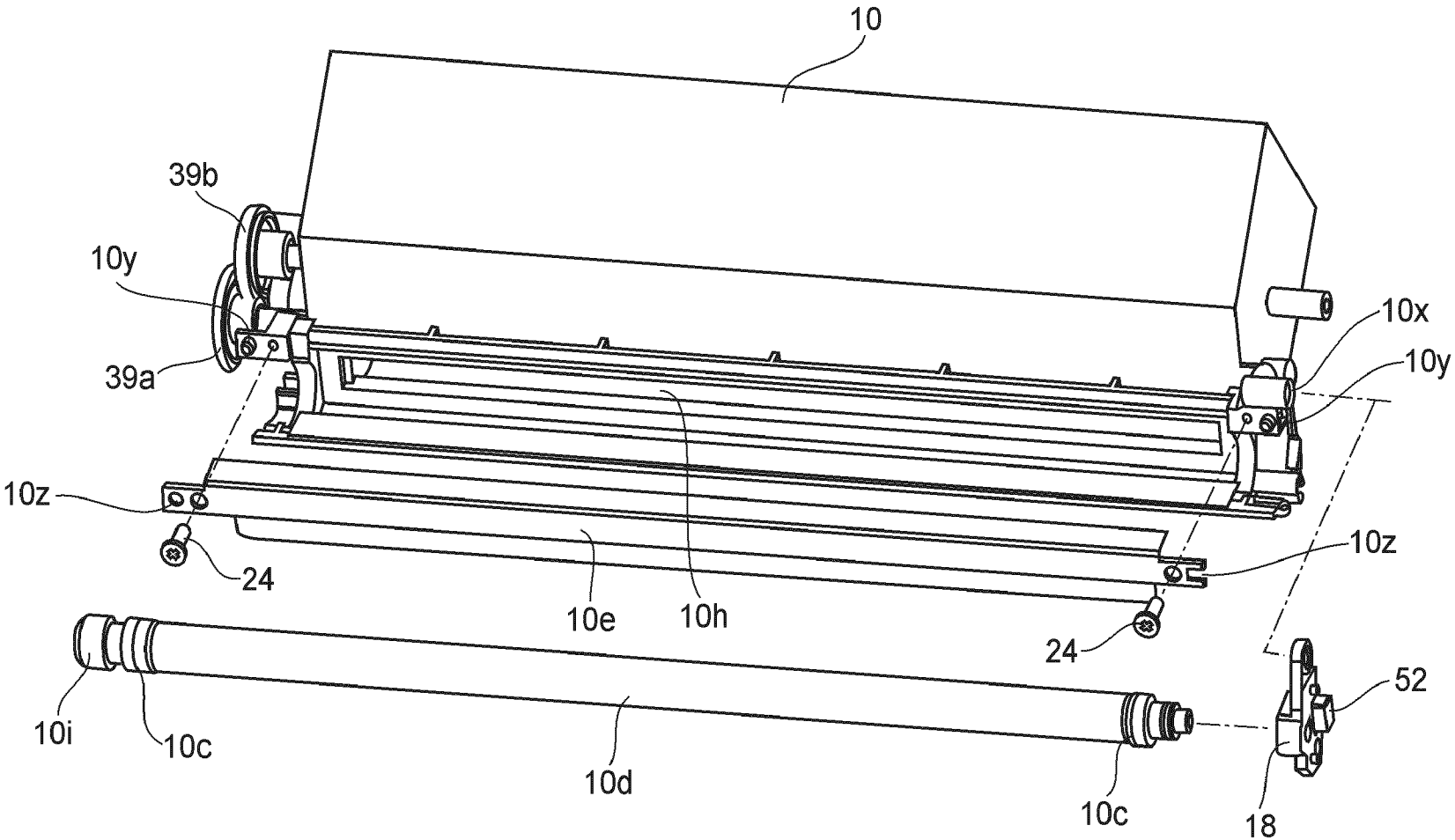
FIG. 20 is a partially exploded perspective view of the development unit after the removal of the development roller and development blade, in addition to the lengthwise end holders, from the development unit frame.

(d) Disassembly of Development Unit, Cleaning of Development Unit Components, Replacement of Development Unit Components, and Reassembly of Development Unit After the separation of the development unit u from the photosensitive member unit v, the development unit u is disassembled. FIG. 19 is a perspective view of the development unit u, from which the first and second lengthwise end holders 81 and 82 have just been removed from the rest of the development unit u. FIG. 20 is a perspective view of the development unit u, from which the development roller 10*d* and development blade 10*e* have just been removed in addition to the two holders 81 and 82.

Referring to FIG. 19, the first lengthwise end holder 81 is provided with a holder positioning projection 81*x*, whereas the development unit frame 10 is provided with a holder positioning hole 10*x*, which corresponds in position to the projection 81*x*. When the first lengthwise end holder 81 is attached to the first lengthwise end of the development unit frame 10, the first lengthwise end holder 81 is held relative to the development unit frame 10 so that the holder positioning projection 81*x* fits in the holder positioning hole 10*x*, and then, the first lengthwise end holder 81 is secured to the development unit frame 10 with the screw 16. Thus, in order to remove the first lengthwise end holder 81, the screw 16 is to be removed. With the removal of the screw 16, the first lengthwise end holder 81, which supports the development roller bearing 18, which supports the first lengthwise end of the development roller 10*d*, can be removed. At the second lengthwise end, the second lengthwise end holder 82 is provided with a holder positioning projection 82*x*, whereas the development unit frame 10 is provided with a holder positioning hole (unshown), which corresponds in position to the projection 82*x*. Thus, when the second lengthwise end holder 82 is attached to the second lengthwise end of the development unit frame 10, the second lengthwise end holder 82 is held relative to the development unit frame 10 so that the holder positioning projection 82*x* fits in the holder positioning hole, and then, the second lengthwise end holder 82 is secured to the development unit frame 10 with the screw 17. Therefore, in order to remove the second lengthwise end holder 82, the screw 17 is to be removed. With the removal of the screw 17, the second lengthwise end holder 82, which supports the second lengthwise end of the development roller 10*d*, can be removed, enabling the development roller 10*d* to be removed from the development unit frame 10. After the removal of the development roller 10*d*, the development roller bearing 18 is removed from the first lengthwise end of the development roller 10*d*.

As for the removal of the development blade 10*e* from the development unit frame 10, the development blade 10*e* is secured to the drum unit frame 11 with the use of a pair of screws 24 after the development blade 10*e* is positioned relative to the drum unit frame 11 by placing the development blade 10*e* in such a manner that the development blade positioning small projections 10*y*, with which the drum unit frame 11 is provided, fit into the development blade positioning holes or slits 10*z*, with which the development blade 10*e* is provided. Therefore, the removal of the screws 24 allows the development blade 10*e* to be removed, as shown in FIG. 20. With the removal of the development blade 10*e*, the developer outlet 10*h*, for supplying the developer t to the development roller 10*d* from the developer storage portion 10*f*, is exposed.

After the removal of the development roller 10*d* and development blade 10*e* from the development unit frame 10, the development unit frame 10 is cleaned, and if necessary, the development roller 10*d* and development blade 10*e* are also cleaned.

Figure 21:
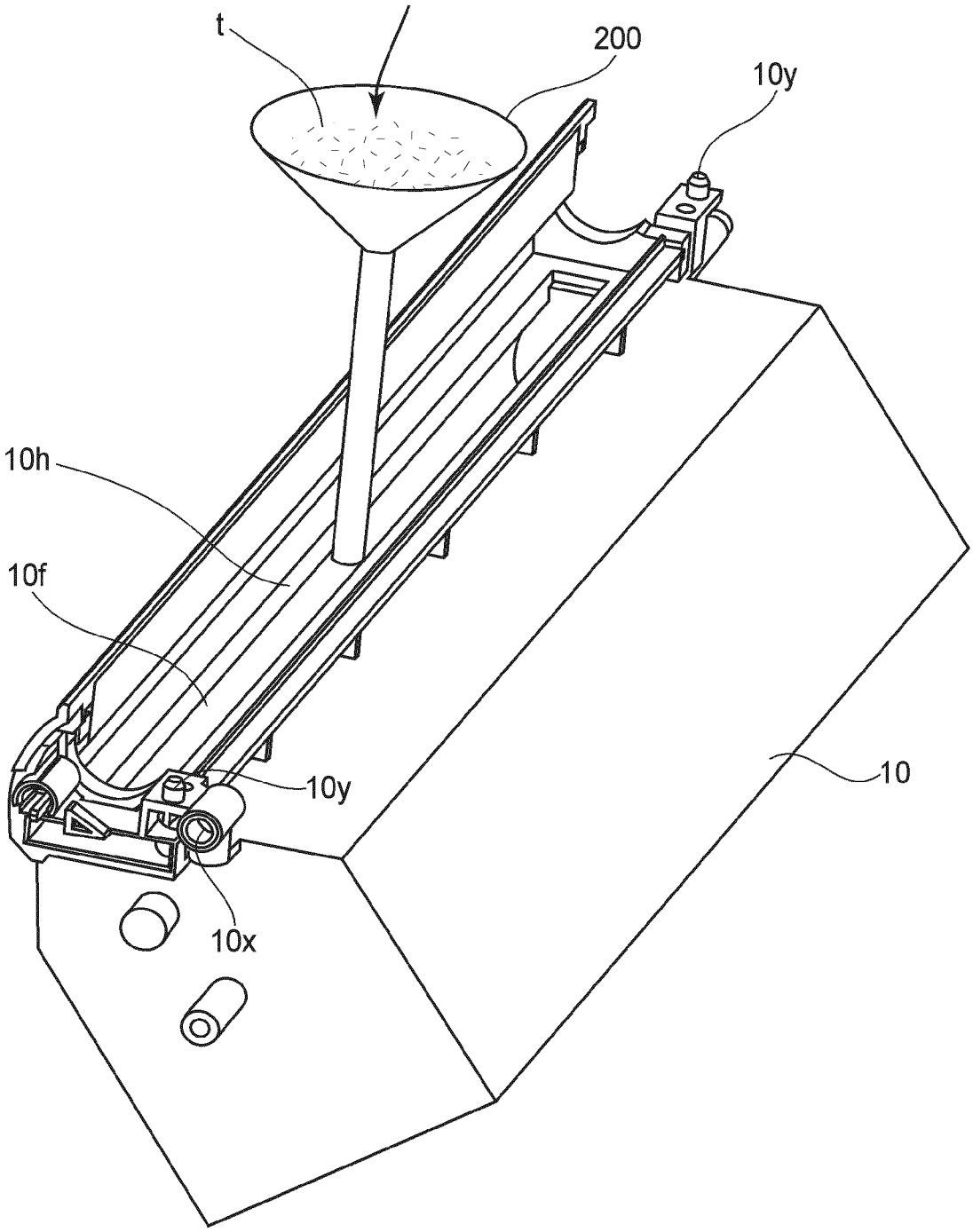
FIG. 21 is a perspective view of the developer storage portion of the development unit, showing how the developer storage portion of the unit can be refilled with developer.

Then, the developer storage portion 10*f* of the development unit frame 10 is refilled with developer through the opening of the developer outlet 10*h*. To describe in more detail the process of refilling the developer storage portion 10*f* with developer, the development unit frame 10 is held so that the developer outlet 10*h* faces upward, as shown in FIG. 21. Then, a funnel, the outlet portion of which is roughly the same in size as, or smaller than, the developer outlet 10*h*, is aligned with, or fitted in, the opening of the developer outlet 10*h*. Then, the developer storage portion 10*f* of the development unit frame 10 is refilled with the preset amount of developer.

In the case of the development unit u, the developer outlet 10*h* can be easily exposed by removing the first and second lengthwise end holders 81 and 82, located at the first and second lengthwise ends, respectively, the development roller 10*d*, and the development blade 10*e* in the listed order after the separation of the development unit u from the photosensitive member unit v from each other. Therefore, the cartridge B (developer storage portion 10*f*) can be easily refilled with developer.

After the refilling of the developer storage portion 10*f* with the developer t through the opening of the developer outlet 10*h*, the developer outlet 10*h* is sealed with the flexible developer seal 61 (sealing member).

Figure 22:
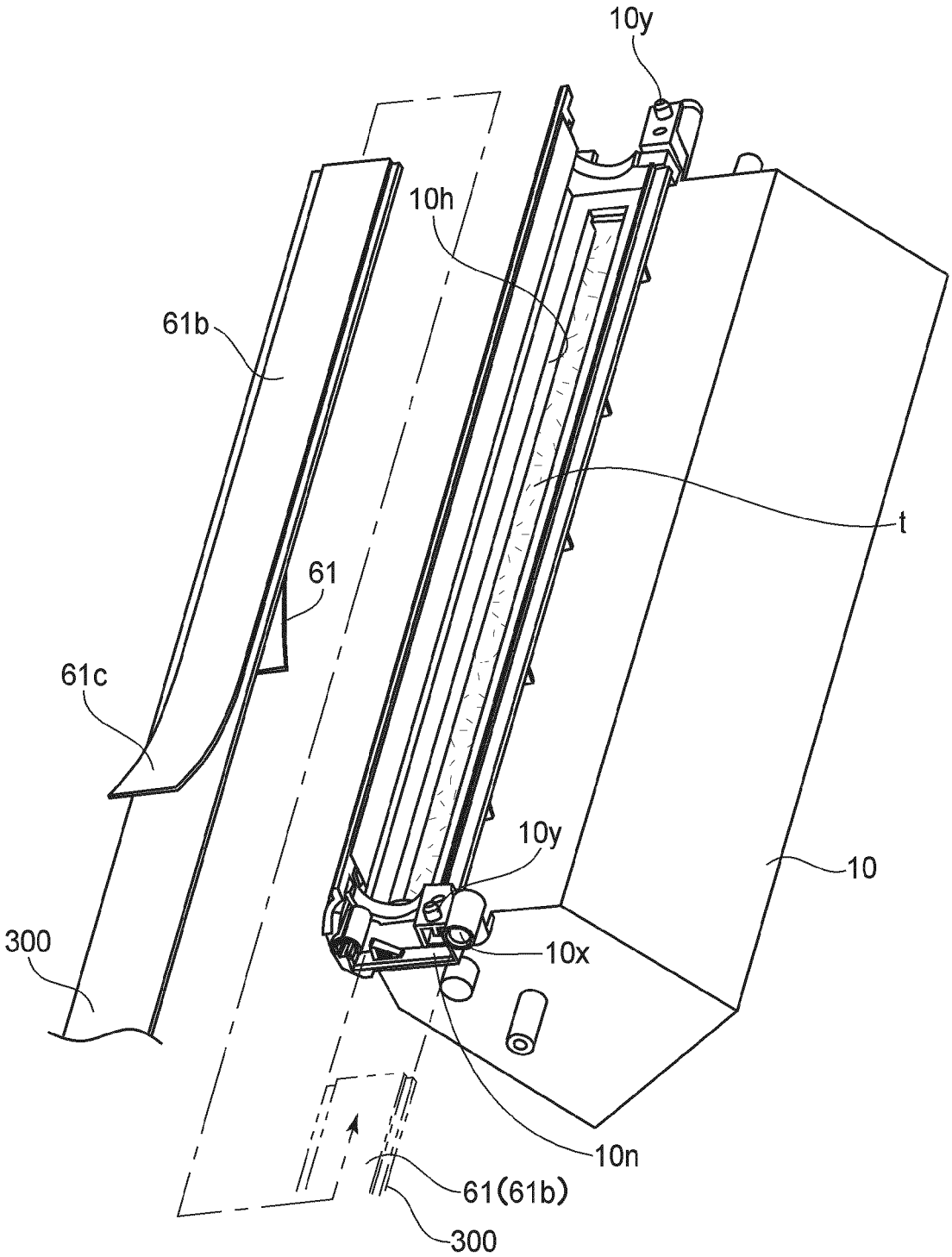
FIG. 22 is a schematic drawing for describing the method for sealing the developer outlet with the developer seal.
Figure 23:
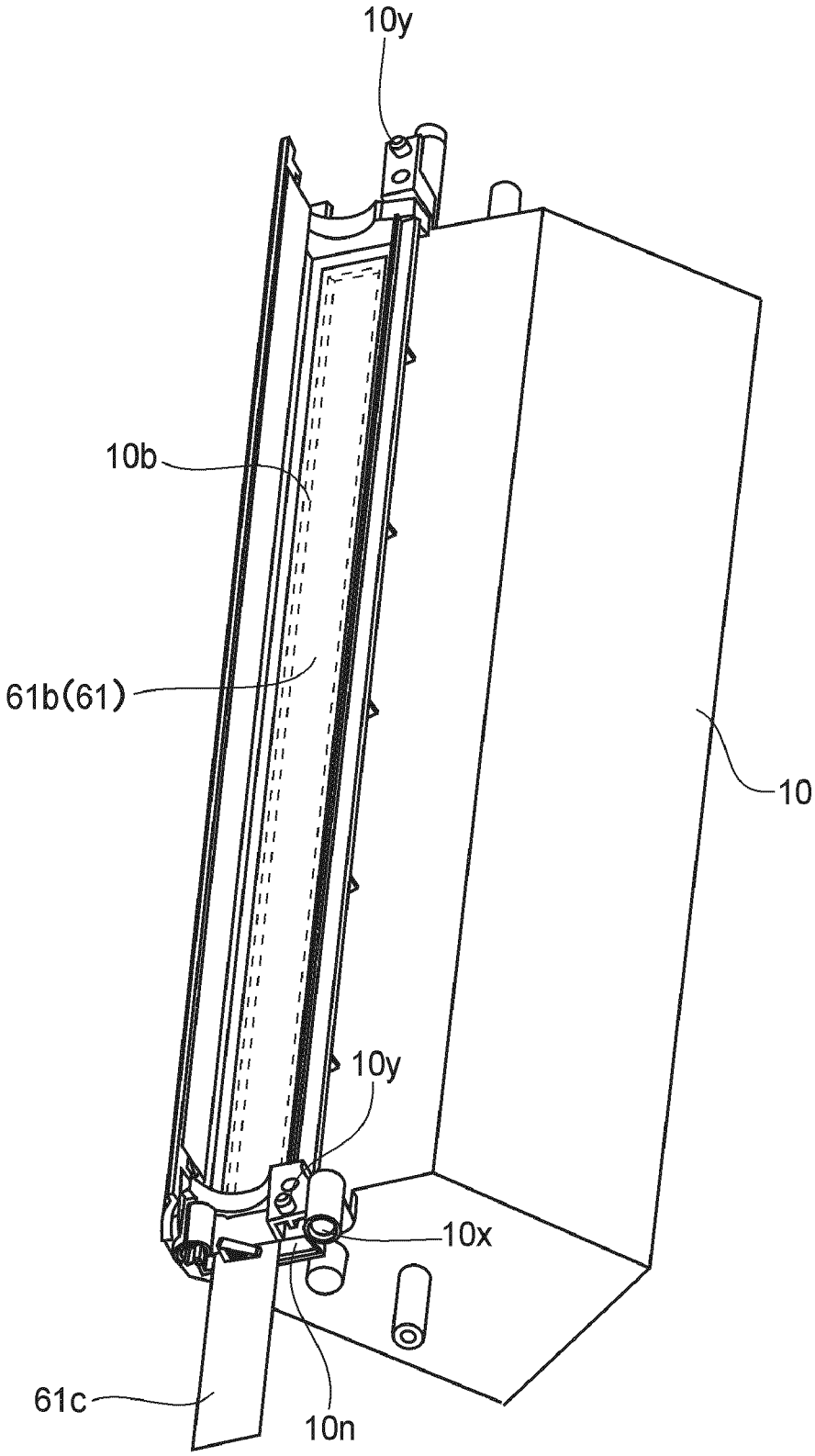
FIG. 23 is a perspective view of the development unit after the sealing of the developer outlet opening with the developer seal.

As for the method for sealing the developer outlet with the developer seal 61, a heating jig 300, such as the one shown in FIG. 22, which is made up of a piece of thin plate, can be used. That is, a brand-new developer seal 61 is inserted into the development unit frame 10 through the developer seal removal slit 10*n*, far enough for the developer seal 61 to reach the opposite end of the developer outlet 10*h* from the developer seal removal slit 10*n* so that the developer seal 61 covers the entirety of the developer outlet 10*h*, with use of the heating jig 30. Then, electricity is made to flow through the heat generating resistive layer of the heating jig 300 in order to raise the temperature of the heating jig 300 to a preset level (150° for example) while the heating jig 300 is still in the development unit frame 10. As the temperature of the heating jig 300 is raised to the preset level, the sealant layer of the developer seal 61 becomes welded to the edges of the opening of the developer outlet 10*h*, thereby sealing the developer outlet 10*h* (developer storage portion 10*f*). Then, the heating jig 300 is pulled out. FIG. 23 shows the development unit frame 10, the developer outlet of which has just been sealed with the developer seal 61. The free end portion 61*c* of the doubled over portion of the developer seal 61 is exposed from the development unit frame 10 through the developer seal removal slit 10*n*. The developer leak prevention seal, with which the developer seal removal slit 10*n* is fitted, is replaced with a brand-new seal as necessary.

Figure 24:
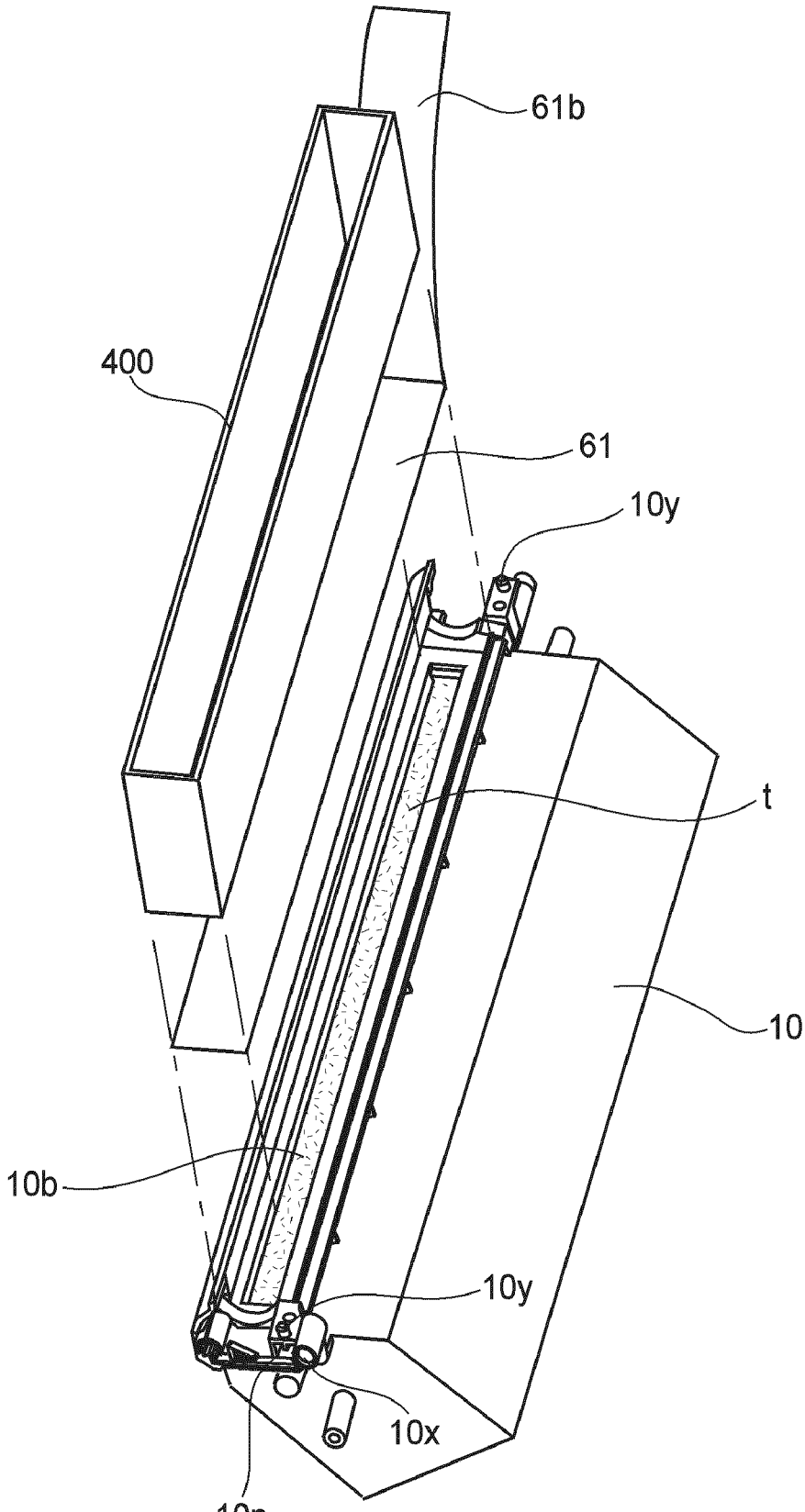
FIG. 24 is a schematic drawing for describing another method for sealing the developer outlet opening with the developer seal.
Figure 25:
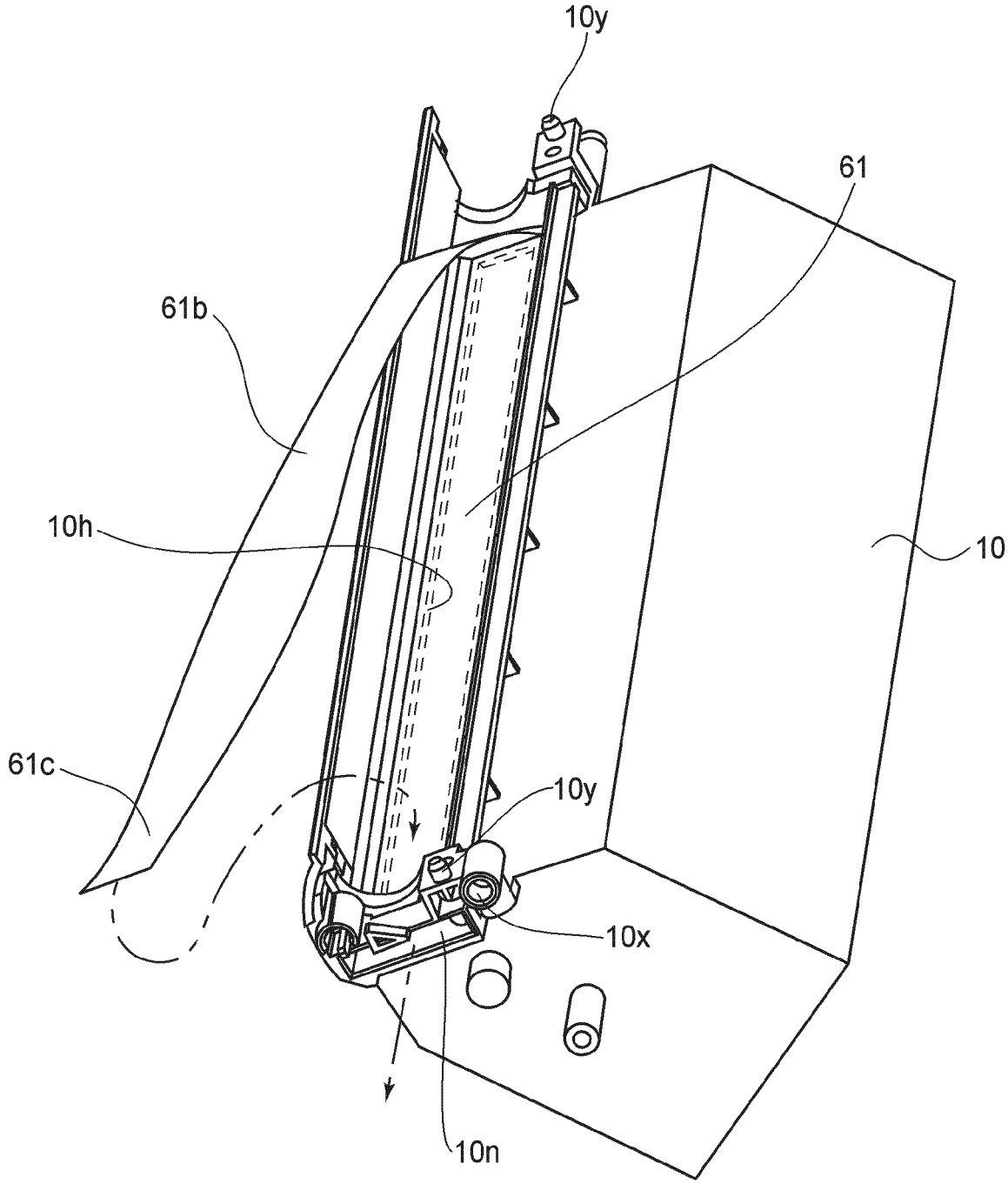
FIG. 25 is a schematic drawing for describing yet another method for sealing the developer outlet opening with the developer outlet seal.

FIG. 24 shows another method for sealing the developer outlet 10*h*. This sealing method uses a heating jig 400 in the form of a rectangular frame, which is long and narrow in cross section. The shape of the heating portion of the heating jig 400 matches that of the opening of the developer outlet 10*h*. The process of sealing the developer outlet 10*h* with this sealing method is as follows: the brand-new developer seal 61 is held to the developer outlet by this heating jig 400 so that the developer seal 61 covers the entirety of the opening of the developer outlet 10*h*. Then, electricity is made to flow through the heat generating resistive layer of the heating jig 400 to raise the temperature of the heating jig 400 to a preset level (150° for example) so that the sealant layer of the developer seal 61 becomes welded to the edge of the opening of the developer outlet 10*h*, thereby sealing the developer outlet 10*h*. Thereafter, the heating jig 400 is removed. After the developer outlet 10*h* is sealed with a part of the developer seal 61, the rest 61*b* of the developer seal 61 is doubled back to the lengthwise end of the developer outlet 10*h*, from which the developer seal 61 was extended to cover the developer outlet 10*h*, and is further extended so that its free end portion 16*c* will be exposed from the development unit frame 10 through the developer removal slit 10*n*, as shown in FIG. 25. After the welding of the developer seal 61, the development unit frame 10 appears as shown in FIG. 23.

It should be mentioned here that the developer seal 61 may be pasted to the edge of the opening of the developer outlet 10*h* with the use of such a bonding means as adhesive or two-sided adhesive tape (when resealing developer outlet 10*h*).

After the completion of the above described developer outlet sealing process, the development unit u is reassembled. That is, the development blade 10*e*, development roller 10*d*, the development roller bearing 18, the first lengthwise end holder 81, and the second lengthwise end holder 82 are attached to the development unit frame 10, after the developer storage portion 10*f* is refilled with developer, and then, the developer outlet 10*h* is sealed with the developer seal 61.

(e) Connection of Photosensitive Member Unit and Development Unit

After the attachment of a brand-new photosensitive drum 7 to the drum unit frame 11 (photosensitive member unit v), refilling of the developer storage portion 10*f* with developer, and resealing of the developer outlet 10*h* with the developer seal 61, the photosensitive member unit v and the development unit u are connected to each other so that they are allowed to rotationally move relative to each other in an oscillatory manner, to complete the process of remanufacturing the cartridge B.

That is, the photosensitive member unit v and the development unit u are attached to each other following in reverse the steps followed to separate them.

More concretely, referring to FIG. 7B, the development unit u is positioned slightly offset toward the second lengthwise end, in terms of its lengthwise direction, relative to its normal position relative to the photosensitive member unit v, as shown in FIG. 7A. Then, the development unit u and the photosensitive member unit v are moved toward each other in the direction perpendicular to their lengthwise direction. As a result, the first and second arm portions 81*a* and 82*a* fit into the recesses 11*p* and 11*q*, respectively, with which the drum unit frame 11 is provided.

After the development unit u is moved relative to the photosensitive member unit v in the direction perpendicular to their lengthwise direction as described above, the development unit u is slid toward the first lengthwise end along the photosensitive member unit v, in their lengthwise direction. As a result, the first columnar portion 81*b* fits into the first hole 11*e*, being thereby supported by the photosensitive member unit v, and the second columnar portion 86 fits into the second hole 11*i*, being thereby supported by the photosensitive member unit v. The second columnar portion 82*b* is fitted into the second hole 11*i* to temporarily support the second lengthwise end of the development unit frame 10 by the drum unit frame 11. That is, the development unit frame 10 is positioned relative to the drum unit frame 11 so that the second bearing 13*c* and first bearing 13*h* can bear the third columnar portion 82*b* and shaft 7*a*1, respectively.

That is, the development unit u is slid toward the first lengthwise end, whereby the first columnar portion 81*b* fits into the first hole 11*e* of the drum unit frame 11. As a result, the first columnar portion 81*b* is borne by the wall of the first hole 11*e* in such a manner than the development unit u is allowed to rotationally move about the first columnar portion 81*b* in an oscillatory manner. Further, the second columnar portion 86 (guiding boss), with which the second lengthwise end holder 82 is provided, and by which the development unit u is temporarily supported, is temporarily supported by the wall of the second hole 11*i* (guiding hole), with which the second lengthwise end of the photosensitive member unit v is provided, and which is for temporarily supporting the development unit u. As a result, the development unit u is moved into its normal position (FIG. 7A) relative to the photosensitive member unit v. That is, all that is necessary to position the development unit u relative to the photosensitive member unit v so that the second bearing 13*c* and first bearing 13*h* can bear the third columnar portion 82*b* and the photosensitive member shaft 7*a*1, respectively, is to attach the supporting member 13 to the drum unit frame 11. The axial line of the third columnar portion 82*b* is in alignment with the axial line of the second columnar portion 86. Further, the gap (play) between the peripheral surface of the second columnar portion 86 and the wall of the second hole 11*i* is made greater than the gap (play) between the peripheral surface of the first columnar portion 81*b* and the wall of the first hole 11*e*, in order to make it easier to support the development unit u with the photosensitive member unit v.

Thereafter, the supporting member 13 is attached to the second lengthwise end of the drum unit frame 11. As the supporting member 13 is attached, the third columnar portion 82*b* fits into the second bearing 13*c*. That is, the second bearing 13*c* supports the third columnar portion 82*b* so that the third columnar portion 82*b* is allowed to rotationally move in an oscillatory manner. Further, the shaft 7*a*1 of the drum gear 7*a* fits into the first bearing 13*h*. That is, at the second lengthwise end, the first bearing 13*h* rotatably supports the shaft 7*a*1. Thereafter, the supporting member 13 is secured to the drum unit frame 11 with the screw 14. After the securing of the supporting member 13 to the drum unit frame 11 with the screw 14, the portion 13*g* of the supporting member 13, which is perpendicularly bent inward of the cartridge B, is flatly in contact with the outward surface of the recessed portion 11*q* of the drum unit frame 11 (FIGS. 3, 4, and 10B). The contact between the portion 13*g* of the supporting member 13 and the outward surface of the recess portion 11*q* reinforces the recess portion 11*q*, thereby preventing the recess portion 11*q* from being deformed by the resiliency of the spring 85.

Here, the gap (play) between the peripheral surface of the second columnar portion 86 and the wall of the second hole 11*i* is made greater than the gap (play) between the peripheral surface of the third columnar portion 82*b* and the wall of the hole of the second bearing 13*c*, in order to prevent the second columnar portion 86 from being supported by the wall of the second hole 11*i*, and also, in order to make the second bearing 13*c* support the third columnar portion 82*b*. Incidentally, the gap between the peripheral surface of the third columnar portion 82*b* and the wall of the hole of the second bearing includes zero. That is, the combination of the second columnar portion 86 and second hole 11*i* has the function of preventing the development unit frame 10 from becoming disengaged from the drum unit frame 11 while the supporting member 13 is securely attached to the drum unit frame 11 (in order to improve cartridge B in assembly efficiency). The gap remains between the second columnar portion 86 and the wall of the second hole 11*i* after the completion of the process of securely attaching the supporting member 13 to the drum unit frame 11. That is, after the secure attachment of the supporting member 13, the second columnar portion 86 is not supported by the wall of the second hole 11*i*. Therefore, the combination of the second columnar portion 86 and the second hole 11*i* is allowed to play the role of temporary positioning means until the supporting member 13 is attached to the drum unit frame 11. That is, the second columnar portion 86 temporarily supports the drum unit frame 11. Incidentally, either the second columnar portion 86 or the second hole 11*i* may be provided with an elastic member (unshown) formed of Moltplane or the like. Even in the case that the second columnar portion 86 or the second hole 11*i* is provided with an elastic member, the combination can play the above described role of temporary positioning means, although the third columnar portion 82*b* remains in contact with the wall of the hole of the second bearing 13*c*.

Referring to FIG. 1A, to the supporting member 13, the spring 20 is attached, which keeps the protective shutter 12 attached to the photosensitive member unit v to protect the photosensitive drum 7, pressured toward its protective position. In this embodiment, the spring 20 is a torsional coil spring. The spring 20 is attached to the supporting member 13 in such a manner that its coiled portion fits around the boss 13*d*, with which the supporting member 13 is provided, and its two arm portions are rested on spring arm seats 13*e* and 13*f*, one for one, so that the torsional force is maintained in the spring 20. Therefore, the supporting member 13 is attached to the drum unit frame 11 after the attachment of the development unit u to the drum unit frame 11. Then, the protective shutter 12 is rotatably attached to the photosensitive member unit v. Then, the protective shutter 12 is moved in the direction to expose the photosensitive drum 7. This movement of the protective shutter 12 places the spring rest portion 12*a* (FIG. 10B) of the protective shutter 12 in contact with the spring 20 as shown in FIG. 10B. Then, the protective shutter 12 is placed under the pressure from the spring 20 by releasing the two arm portions of the spring 20 from the spring rest 13*f* of the supporting member 13. The spring rest portion 12*a* is tilted in the direction to cause the spring 20 to slide toward the lengthwise center of the drum unit frame 11. Thus, the spring 20 becomes disengaged from the spring rest 13*f* of the supporting member 13 by the opening or closing movement of the protective shutter 12.

Thus, it is possible to provide a simple process cartridge remanufacturing method, which requires only ordinary tools, that is, without requiring tools dedicated to the remanufacturing of the process cartridge.

Further, it is possible to provide a process cartridge remanufacturing method which makes it possible to reuse a process cartridge from which its developer has been completely consumed.

Further, it is possible to provide a process cartridge remanufacturing method which is simple in the process of refilling a process cartridge with developer.

The summary of the above described process cartridge remanufacturing method in this embodiment is as follows:

The process cartridge remanufacturing method in this embodiment is a method for remanufacturing the cartridge B having the drum unit frame 11 and development unit frame 10. The drum unit frame 11 supports the electrophotographic photosensitive drum 7 at its first and second lengthwise ends. The development unit frame 10 supports the development roller 10*d* for developing an electrostatic latent image formed on the electrophotographic photosensitive drum 7, at the first and second lengthwise ends of the development roller 10*d*, and has the developer storage portion 10*f* which stores the developer t used for developing the abovementioned electrostatic latent image by the abovementioned development roller 10*d*. The drum unit frame 11 and development unit frame 10 are connected to each other in such a manner that they are rotationally movable relative to each other.

(i) The process cartridge remanufacturing method has the following process for removing the supporting member: the second lengthwise end of the electrophotographic photosensitive drum 7 is rotatably supported, and the second lengthwise end of the development unit frame 10 is supported so that it is movable relative to the drum unit frame 11 in an oscillatory manner. Then, the supporting member 13, which is attached to the second lengthwise end of the drum unit frame 11, is removed from the drum unit frame 11.

(ii) It has the process for separating development unit frame 10 from the drum unit frame 11 after the removal of the supporting member 13 through the above described supporting member removing process.

(iii) It has the process for removing the first lengthwise end of the electrophotographic photosensitive drum 7 from the first lengthwise end of the drum unit frame 11, which was separated through the above described process for separating the two frames 10 and 11, from each other.

(iv) It has the process for attaching the first lengthwise end of a brand-new electrophotographic photosensitive drum 7 to the first lengthwise end of the development unit frame 10, from which the used electrophotographic photosensitive drum 7 has just been removed through the above described drum removal process.

(v) It has the process for refilling the developer storage portion 10*f* of the development unit frame 10 with the developer t after the separation of the development unit u from the electrophotographic photosensitive member unit v, through the above described process for separating the two frames 10 and 11.

(vi) It has the following processes for connecting the two frames (units): After the attachment of the brand-new electrophotographic photosensitive drum 7 to the drum unit frame 11, the second lengthwise end of the electrophotographic photosensitive drum 7 is rotatably supported by the supporting member 13. Then, after the refilling of the developer storage portion 10*f* with the developer t, the supporting member 13 is attached to the second lengthwise end of the drum unit frame 11 while supporting the second lengthwise end of the development unit frame 10 in such a manner that it is movable relative to the drum unit frame 11 in an oscillatory manner. Thus, the development unit frame 10 and drum unit frame 11 are connected to each other in such a manner that the two frames 10 and 11 are movable relative to each other in an oscillatory manner.

The above described process for separating the two frames 10 and 11 from each other include steps for pulling out the first columnar portion 81*b*, which projects from the end of first arm portion 81*a* in the direction intersectional to the lengthwise direction of the development unit frame 10, at the first lengthwise end of the development unit frame 10, from the first hole 11*e*, with which the first lengthwise end of the drum unit frame 11 is provided. The process also include the steps for pulling the second columnar portion 86, which projects from the end of the second arm portion 82*b* in the direction intersecting the lengthwise direction of the development unit frame 10, from the second hole 11*i* with which the second lengthwise end of the drum unit frame 11 is provided, at the second lengthwise end of the development unit frame 10. Further, the above described process for connecting the two frames 10 and 11 includes the steps for inserting the first and second columnar portions 81*b* and 86 into the first and second holes 11*e* and 11*i*, respectively.

Further, the above described supporting member removal process include the steps for removing the screw 14, with which the supporting member 13 is secured to the drum unit frame 11. The process also include the steps for removing the first bearing 13*h*, of the supporting member 13, from the shaft 7*a*1, with which the second lengthwise end of the electrophotographic photosensitive drum 7 is provided, and the step of removing the second bearing 13*c*, of the supporting member 13, from the third columnar portion 82*b*, which is the opposite end portion of the second columnar portion 86.

Further, the drum removal process includes the steps for pulling the shaft 21, with which the first lengthwise end of the drum unit frame 11 is provided, from the hole 7*b*, with which the first lengthwise end of the electrophotographic photosensitive drum 7 is provided. Further, the drum attachment process includes the steps for inserting the abovementioned shaft 21 into the abovementioned hole 7*b* of the electrophotographic photosensitive drum 7 when attaching the first lengthwise end of a brand-new electrophotographic photosensitive drum 7, to the first lengthwise end of the drum unit frame 11.

Further, the process cartridge remanufacturing method has the process for removing the development roller 10*d* from the development unit frame 10. The process for removing the development roller includes the steps for removing the first lengthwise end holder 81, which supports the development roller bearing 18 supporting the first lengthwise end of the development roller 10*d*, and which is secured to the development unit frame 10 with the screws, by removing the screws 16 and 17, and also, the step for removing the second lengthwise end holder 82, which supports the second lengthwise end of the development roller 10*d*, and which is secured to the development unit frame 10 with the screws.

Further, it has the development roller bearing removing process, through which the development roller bearing 18, which supports the first lengthwise end of the development roller 10*d*, after the removal of the first lengthwise end holder 81 through the above described first lengthwise end holder removal steps.

Further, it has the development blade removal process carried out after the removal of the development roller 10*d* from the development unit frame 10 through the above described development roller removal process. That is, the development blade 10*e*, which is secured to the development unit frame 10 with the screws 24 to regulate the amount by which the developer t is allowed to remain adhered to the peripheral surface of the development roller 10*d*, is removed by removing the screws 24. Further, the developer outlet 10*h* for delivering the developer t from the developer storage portion 10*f* to the development roller 10*d* is exposed by removing the development blade 10*e* through the above described development blade removal process. Then, the developer storage portion 10*f* is refilled with the developer t through the opening of the developer outlet 10*h*, through the developer storage portion refilling process described previously.

Further, it has the process for sealing the developer outlet 10*h* with the sealing member 61 after the developer storage portion 10*f* is refilled with the developer t through the developer outlet 10*h*, through the previously described developer storage refilling process.

The cartridge B is provided with the pair of springs 85, which are attached to the first and second lengthwise end holders 81 and 82, respectively, to keep the development roller 10*d* pressured toward the electrophotographic photosensitive drum 7, with the presence of the pair of spacer rings 10*c* between the development roller 10*d* and electrophotographic photosensitive drum 7. The springs 85 are removed from the first and second lengthwise ends of the development unit frame 10 by removing the first and second holders 81 and 82 from the development unit frame 10, respectively.

After the completion of the supporting member removal process, the development unit frame 10 is positioned relative to the drum unit frame 11 so that the second and first bearings 13*c* and 13*h* are enabled to support the third columnar portion 82*b* and shaft 7*a*1, respectively, before the process for separating the development unit frame 10 and drum unit frame 11 from each other are started.

Through the process for separating the development unit frame 10 and drum unit frame 11 from each other, the second columnar portion 86 is removed from the second hole 11*i*.

Also through the process for separating the development unit frame 10 and drum unit frame 11 from each other, the development unit frame 10 is slid in its lengthwise direction along the drum unit frame 11, toward the second lengthwise end. The process causes the first and second columnar portions 81*b* and 86 to come out of the first and second holes 11*e* and 11*i*, respectively. Thereafter, the development unit frame 10 is moved along the drum unit frame 11 in the direction intersectional to its lengthwise direction, whereby the development unit frame 10 becomes separated from the drum unit frame 11.

Further, before the supporting member 13 is attached through the process for connecting the development unit frame 10 and drum unit frame 11 to each other, the development unit frame 10 is positioned relative to the drum unit frame 11 so that it becomes possible for the second and first bearings 13*e* and 13*h* to support the third columnar portion 82*b* and shaft 7*a*1, respectively.

Further, in the process for connecting the development unit frame 10 and drum unit frame 11 to each other, the development unit frame 10 is slid in its lengthwise direction along the drum unit frame 11, toward the first lengthwise end so that the first and second columnar portions 81*b* and 86 are moved into the first and second holes 11*e* and 11*i* to support the first and second columnar portions 81*b* and 86 by the drum unit frame 11.

Also in the above described process for connecting the two frames 10 and 11, the development unit frame 10 is slid in its lengthwise direction along the drum unit frame 11 toward the first lengthwise end, after the development unit frame 10 is moved relative to the drum unit frame 11 in the direction intersectional to their lengthwise direction. This sliding movement of the development unit frame 10 causes the first and second columnar portions 81*b* and 86 to enter the first and second holes 11*e* and 11*i*. As a result the first and second columnar portions 81*b* and 86 are supported by the drum unit frame 11.

Incidentally, the above described processes may be simultaneously carried out by multiple workers. Further, the order in which the processes are carried out may be different from the order in which they are carried out in this embodiment.

In the case of the cartridge remanufacturing method in this embodiment, recovered used process cartridges are disassembled, and the components resulting from the disassembly of the used process cartridges are examined and sorted according to preset standards and categories. Then, the components which meet the preset standards are reused to manufacture process cartridges with the use of the above described process cartridge remanufacturing method. The components which were determined to be not reusable are replaced with brand-new ones.

Not only do the components of the cartridge B include the development unit frame 10, development roller 10*d*, drum unit frame 11, first lengthwise end holder 81, and second lengthwise end holder 82, which were described above, but also, the other components removed from the cartridge B.

Further, the process cartridge remanufacturing method in this embodiment include a process cartridge remanufacturing method in which a process cartridge is manually assembled by a worker using jigs, and also, a process cartridge remanufacturing method in which a process cartridge is automatically assembled by robots.

Further, the above described process cartridge remanufacturing method includes a process cartridge remanufacturing method in which a process cartridge is assembled using the combination of the manual and automatic processes.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 283422/2007 filed Oct. 31, 2007, which is hereby incorporated by reference.

What is claimed is:

1. A remanufacturing method for a process cartridge detachably mountable to a main assembly of an electrophotographic image forming apparatus, wherein said process cartridge includes:

an electrophotographic photosensitive drum;

a developing roller for developing an electrostatic latent image formed on said electrophotographic photosensitive drum;

a developing device frame supporting said developing roller at one and the other longitudinal ends of said process cartridge, said developing device frame including (a) a developer accommodating portion for accommodating a developer to be used for development of the electrostatic latent image by said developing roller, (b) a one end portion-to-be-supported provided at said one end, (c) an other end portion-to-be-supported provided at said other end, and (d) a temporary portion-to-be-supported provided at said other end;

a drum frame rotatably supporting said electrophotographic photosensitive drum at said one end, said drum frame including (a) a one end supporting portion swingably supporting said one end portion-to-be-supported at said one end, and (b) a temporary supporting portion for temporarily supporting said temporary portion-to-be-supported at said other end;

a supporting member mounted to said drum frame, said supporting member including (a) a drum supporting portion rotatably supporting said electrophotographic photosensitive drum at said other end, and (b) an other end supporting portion for swingably supporting other end portion-to-be-supported at said other end;

said method comprising:

(i) a supporting member dismounting step of separating said drum supporting portion from said electrophotographic photosensitive drum and separating said other end supporting portion from said other end portion-to-be-supported to dismount said supporting member from said drum frame so that said temporary portion-to-be-supported is temporarily supported by said temporary supporting portion;

(ii) frame separating step, after said supporting member dismounting step, of separating said one end portion-to-be-supported from said one end supporting portion at said one end and separating said temporary portion-to-be-supported from said temporary supporting portion at said other end to separate said developing device frame and said drum frame from each other;

(iii) a drum dismounting step, after said frame separating step, of dismounting said electrophotographic photosensitive drum from said drum frame at said one end;

(iv) a drum mounting step, after said drum dismounting step, of mounting a fresh electrophotographic photosensitive drum to said drum frame at said one end;

(v) a developer refilling step of refilling the developer into said developer accommodating portion of said developing device frame; and (vi) a frame coupling process of supporting said one end portion-to-be-supported by said one end supporting portion at said one end, temporarily supporting said temporary portion-to-be-supported by said temporary supporting portion at said other end, thereafter rotatably supporting the fresh electrophotographic photosensitive drum by said drum supporting portion at said other end, swingably supporting said other end portion-to-be-supported by said other end supporting portion at said other end, and mounting said supporting member to said drum frame at said other end to swingably connect said developing device frame and said drum frame to each other.

2. A method according to claim 1, wherein said one end portion-to-be-supported includes a first circular column portion provided at a free end portion of a first arm portion projected in a direction crossing with the longitudinal direction at said one end, and said one end supporting portion includes a first hole for receiving said first circular column portion, wherein said temporary portion-to-be-supported includes a second circular column portion provided at a free end portion of a second arm portion projected in the crossing direction at said other end, and said temporary supporting portion includes a second hole for receiving said second circular column portion, and wherein said other end portion-to-be-supported includes a third circular column portion provided at a free end portion of the second arm portion projected in the crossing direction at said other end, and said other end supporting portion includes a third hole for receiving said third circular column portion.

3. A method according to claim 2, wherein said supporting member dismounting step includes a screw removing step of removing a screw fixing said supporting member to said drum frame, dismounting said drum supporting portion from a shaft provided on said electrophotographic photosensitive drum at said other end, and dismounting said third hole from said third circular column portion in a side opposite a side where said second circular column portion is inserted into said second hole.

4. A method according to any one of claims 1-3, wherein said drum dismounting step includes a step of drawing out one end shaft provided on said drum frame from a drum hole provided in said electrophotographic photosensitive drum at said one end, and wherein said drum mounting step includes a step of inserting said one end shaft into said drum hole in mounting the fresh electrophotographic photosensitive drum to said drum frame at said one end.

5. A method according to any one of claims 1-3, further comprising a developing roller dismounting step of dismounting said developing roller from said developing device frame, wherein said developing roller dismounting step includes one end holder dismounting step of dismounting one end holder supporting a developing roller bearing supporting said developing roller at said one end and screwed to said developing device frame, by removing a screw, and an other end holder dismounting step of dismounting the other end holder supporting a developing roller bearing supporting said developing roller at said other end and screwed to said developing device frame, by removing a screw.

6. A method according to claim 5, further comprising a developing roller shaft reception dismounting step of dismounting a developing roller bearing supporting said developing roller at said one end after said one end holder dismounting step dismounts said one end holder.

7. A method according to claim 6, further comprising a developing blade dismounting step of dismounting a developing blade for regulating an amount of the developer deposited on a peripheral surface of said developing roller screwed to said developing device frame, by removing a screw after said developing roller dismounting step dismounts said developing roller from said developing device frame, wherein a developer supply opening for supplying the developer to said developing roller from said developer accommodating portion is exposed by dismounting said developing blade by said developing blade dismounting step, and thereafter, the developer is refilled from said developer supply opening in said developer refilling step.

8. A method according to claim 7, wherein further comprising a sealing step of sealing said developer supply opening by a sealing member after said developer refilling step refills the developer through said developer supply opening.

9. A method according to any one of claim 8, wherein said one end holder and said other end holder are each provided with a spring for urging said developing roller toward said electrophotographic photosensitive drum through a spacer roller, and wherein said spring is removed from said developing device frame by dismounting said one end holder and said other end holder from said developing device frame.

10. A method according to claim 2 or 3, wherein in said frame separating step, said developing device frame is slid from said one end portion toward said other end portion in the longitudinal direction relative to said drum frame, by which said first hole is separated from said first circular column portion, and said second hole is separated from said second circular column portion, and thereafter, said developing device frame is moved in a direction crossing with the longitudinal direction relative to said drum frame, by which said developing device frame is separated from said drum frame.

11. A method according to claim 2, wherein before said frame coupling process mounts said supporting member to said drum frame, supporting said temporary portion-to-be-supported by said temporary supporting portion, so that said developing device frame is positioned relative to said drum frame where said third hole is engageable with said third circular column portion, and said drum supporting portion is engageable with said shaft.

12. A method according to claim 2, wherein in said frame coupling step, said developing device frame is slid relative to said drum frame in the longitudinal direction from said other end portion toward said one end portion, by which said first circular column portion is supported by said first hole, and said second circular column portion is supported by said second hole.

13. A method according to claim 2, wherein in said frame coupling step, said developing device frame is moved relative to said drum frame in a direction crossing with the longitudinal direction, and thereafter, said developing device frame is slid relative to the drum frame in the longitudinal direction from said other end portion toward said one end portion, by which said first hole supports said first circular column portion, and said second hole supports said second circular column portion.

* * * * *